US005194043A

United States Patent [19]

Takahashi et al.

[11] Patent Number: 5,194,043

[45] Date of Patent: Mar. 16, 1993

[54] AIR CONDITIONER AIR DEFLECTOR ARRANGEMENT

[75] Inventors: Norio Takahashi; Masato Sugita; Seimei Okabe, all of Tochigi; Kuniyuki Yamada; Kazunari Minami, both of Kashiwa; Yoshimi Inoue, Ibaraki; Yasuyuki Sakamoto, Tochigi, all of Japan

[73] Assignee: Hitachi, Ltd., Tokyo, Japan

[21] Appl. No.: 808,765

[22] Filed: Dec. 17, 1991

Related U.S. Application Data

[63] Continuation of Ser. No. 523,570, May 15, 1990, abandoned.

[30] Foreign Application Priority Data

| | | | |
|---|---|---|---|
| May 25, 1989 | [JP] | Japan | 1-132227 |
| Jul. 7, 1989 | [JP] | Japan | 1-174011 |
| Aug. 4, 1989 | [JP] | Japan | 1-201236 |

[51] Int. Cl.[5] ..... F24F 13/08

[52] U.S. Cl. ..... 454/316; 62/404

[58] Field of Search ..... 98/40.24, 40.25, 40.27, 98/40.28, 110, 114; 62/404, 407, 408, 409, 410

[56] References Cited

U.S. PATENT DOCUMENTS

| | | | |
|---|---|---|---|
| 2,086,022 | 2/1937 | Feinberg | 98/40.27 |
| 3,177,797 | 4/1965 | Kennedy | 98/110 |
| 3,332,334 | 7/1967 | Melzer | 454/192 |
| 3,648,592 | 3/1972 | Nieboer | 98/110 |
| 3,812,772 | 5/1974 | Kaiser | 98/110 |
| 3,952,639 | 4/1976 | Nobata | 98/40.24 |
| 4,782,999 | 11/1988 | Ishii et al. | 98/40.25 |

*Primary Examiner*—Henry A. Bennett
*Assistant Examiner*—William C. Doerrler
*Attorney, Agent, or Firm*—Antonelli, Terry, Stout & Kraus

[57] ABSTRACT

An air conditioner has rotatable first and second deflectors provided in an outlet for discharging conditioned air. The first deflector is rotatable about a substantially horizontal axis so as to variably deflect the conditioned air in vertical directions. The second deflector is rotatable so as to block a breadthwise portion of the outlet while forming an air passage in the remainder breadthwise portion of the outlet. The first and second deflectors are rotatable independently of each other.

12 Claims, 22 Drawing Sheets

AIR CONDITIONER AIR DEFLECTOR ARRANGEMENT

This is a continuation of application Ser. No. 07/523,570, filed May 15, 1990, now abandoned.

BACKGROUND OF THE INVENTION

1. Field of the Invention

The present invention relates to an air conditioner and, more particularly, to an air conditioner is provided with an air deflecting device for concentrating conditioned air to a predetermined region in the breadthwise or horizontal direction of the air outlet so as to enhance the velocity of air discharged from the air conditioner.

2. Description of the Related Art

In for example, Japanese Patent Unexamined Publication No. 62-276359, an air conditioner is proposed which includes air deflecting device for selectively deflecting an air flow in the vertical and horizontal directions, and in Japanese Utility Model Unexamined Publication No. 62-2944 an air conditioner is proposed having an air deflecting device including a main deflector plate disposed below the outlet of the air conditioner and an auxiliary deflector plate disposed above the main deflector plate. These deflector plates are capable of deflecting the air in the vertical direction and are provided over the entire breadth, i.e., the horizontal length, of the air outlet so that the air is distributed in the horizontal direction.

Japanese Patent Unexamined Publication No. 60-169025 discloses air deflection vanes for vertically deflecting driven by a rotational position control device including a member made of a shape memory alloy with the deflection vanes extending over the entire breadth of the air outlet.

Japanese Patent Unexamined Publication No. 57-73331 discloses an air conditioner having two air outlets so that conditioned air is discharged upwardly to the outside of a living space when a heat source is switched on, whereas, when the heat source is switched off, the conditioned air is discharged into the living space. With the air deflector plates at both air outlets being inclined at the same inclination angle.

Japanese Patent Examined Publication No. 58-4256 discloses an automotive air conditioner having a central air outlet portion composed of a pair of outlets, one for the driver and the other for a passenger, with the outlets being independently manually adjustable to deflect conditioned air vertically and horizontally; however, no means are provided for concentrating air to the central regions of both air outlets by blocking outer regions of the outlets.

In the above described conventional constructions, the air damper plates or deflecting plates are arranged over an entire breadth of the air outlet and the damper and deflector plates are rotated or inclined so as to deflect the conditioned air in the vertical direction or to direct the air in one direction, but the air is uniformly distributed over the entire breadth of the air outlet so that a uniform flow of discharged air is formed along the outlet of the air conditioner.

Thus, none of the conventional constructions proposed locally blocking the flow of the discharged air to concentrate the air flow to the central, left or right region of the air outlet so as to enable the conditioned air to reach a desired zone where the conditioned air is specifically demanded by the user, e.g., a zone in a room where many persons may be gathered.

Recently, inverter-driven air conditioners have become popular with this type of air conditioner being capable of producing a large heating output to cope with a demand for heating in winter. In general, an inverter-driven air conditioner is so designed that, when a steady condition is attained at a set room air temperature, the operation is changed to a low-output mode so as to minimize frequency of cycling of the power, thus attaining economy. Under such a steady condition, in an air conditioned room a considerably low air temperature tends to be developed in the region near the floor as compared with the air at a head level, even when measures are taken to reduce such a temperature difference.

In general, when air conditioning a room from physical and physiological points of view, the air temperature around a floor area of a room should preferably be higher to some extent than the temperature of air at a head level.

Under these circumstances, there is an increasing demand for an air conditioner which can direct and concentrate conditioned air, for example, heated air, locally to a desired zone in a room, such as, for example, the floor of the room.

SUMMARY OF THE INVENTION

Accordingly, an object of the present invention is to provide an air conditioner which is operative to concentrate conditioned air to a desired zone in a room, thereby overcoming the disadvantages encountered in the prior art.

To this end, according to the present invention, an air conditioner includes an outlet for conditioned air and an air deflecting means associated with the outlet with the air deflecting means comprising a first air deflector capable of rotating about a substantially horizontal axis to variably deflect the conditioned air through the outlet, and a second air deflector rotatable to block a breadthwise portion of the outlet while allowing at least one other breadthwise portion of the outlet to form a passage for the conditioned air to be discharged.

According to the invention, it is possible to concentrically direct conditioned air to a desired zone in a room. In case of an air heating operation, therefore, it is possible to enable heated air to reach a zone near the floor of the room so as to achieve a quick heating. Similarly, it is possible to quickly cool a desired zone in the room in a cooling mode. The invention also makes it possible to gently condition room air as desired. The air conditioner of the present invention is simple in construction and is inexpensive. The simple construction reduces the occurrence of troubles and facilitates easy maintenance and repair.

The above and other objects, features and advantages of the present invention will become clear from the following description when taken in conjunction with the accompanying drawings.

DESCRIPTION OF THE PREFERRED EMBODIMENTS

Figure 1:
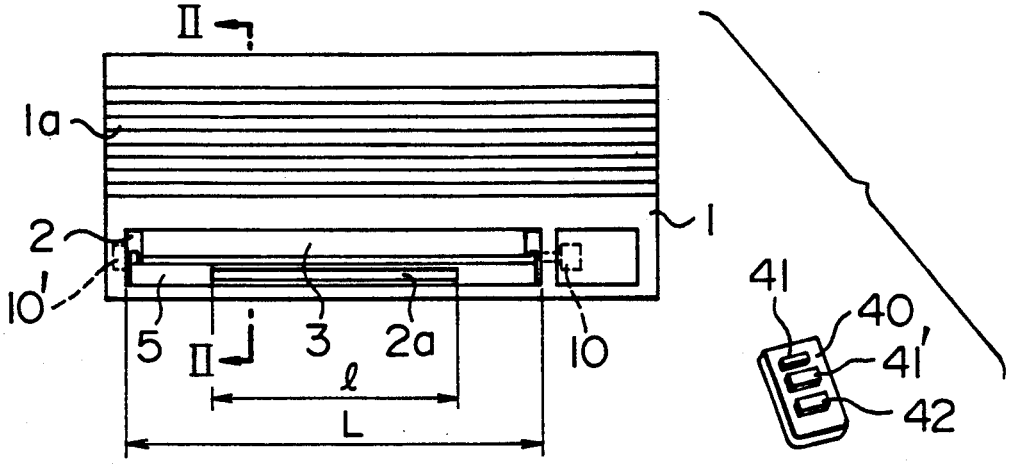
FIG. 1 is a multi component front elevational view of a room unit of an embodiment of the air conditioner in accordance with the present invention.
Figure 2:
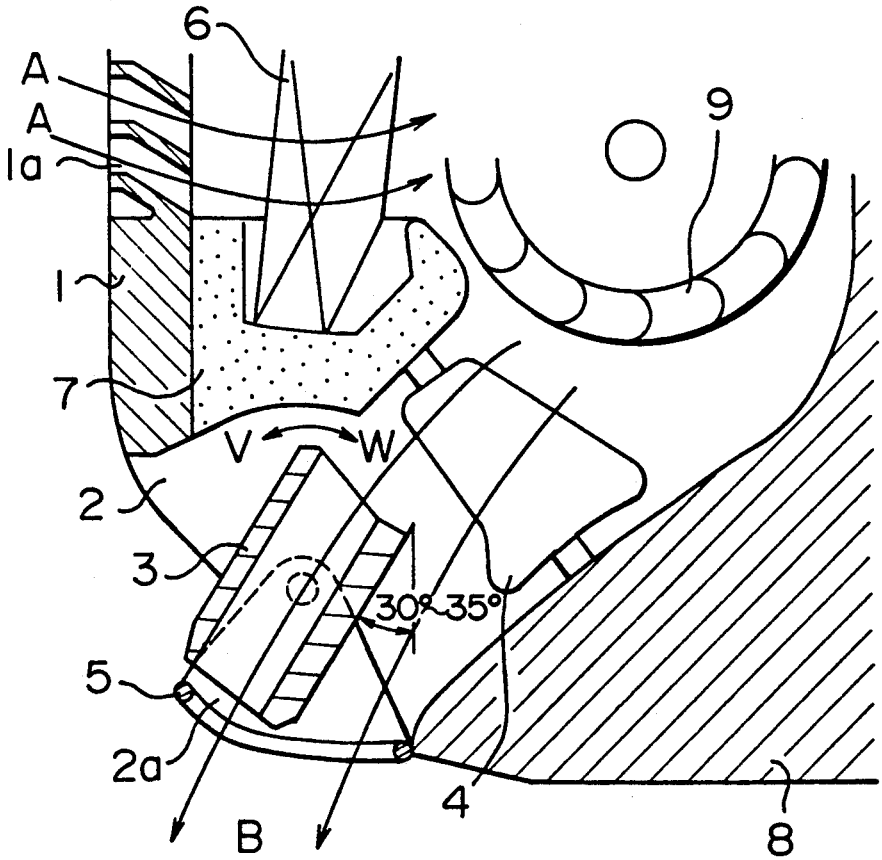
FIG. 2 is an enlarged sectional view taken along the line II—II in FIG. 1.
Figure 3:
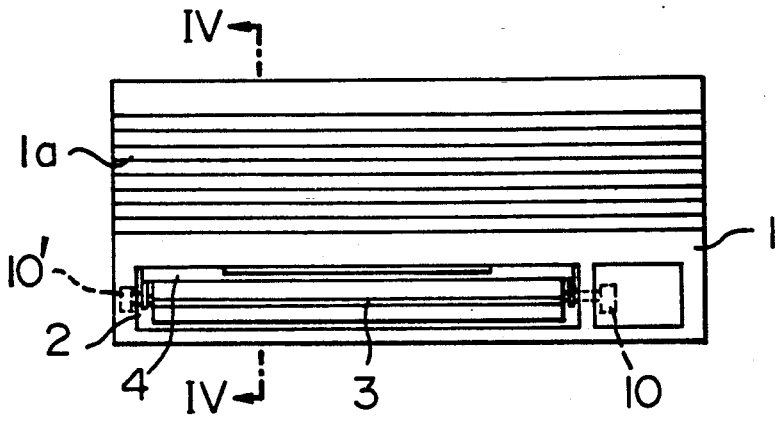
FIG. 3 is a front elevational view of the unit shown in FIG. 1 in a mode in which air is served through the entire breadthwise dimension of an air outlet.

Referring now to the drawings wherein like reference numerals are used throughout the various views to designate like parts and, more particularly, to FIGS. 1 and 2, according to these figures, the main part of the air conditioner, i.e., a room unit, has a front cover 1 which has an air inlet 1*a* through which room air is drawn into the air conditioner and an outlet 2 for discharging conditioned air into the room. The unit also has a horizontal vane 3 which serves as a first deflector for vertically and variably deflecting the air discharged from the outlet 2, and a vertical vane 4 serving as a second deflector for deflecting the air to the right and left in a variable manner.

The unit also has a movable vane 5 which is operative independently of the horizontal and vertical vanes 3 and 4 and serves as a third deflector. This movable vane 5 is partially opened so as to form an air passage 2*a* while the remainder of the outlet 2.

The room unit also has a heat exchanger 6 and a drain pan 7 cooperating with a housing 8 to define an air outlet passage. A blower 9 draws air into the room unit through the inlet 1*a* and then through the heat exchanger 6 as indicated by arrows A. The air, conditioned by the heat exchanger 6, is discharged by the blower 9 into the room as indicated by the arrows B.

A horizontal vane drive motor 10, which may be a stepper motor and serve as a first deflector motor, is directly connected to a shaft of the horizontal vane 3.

A movable vane drive motor 10', which may be a stepper motor and serve as a second deflector motor, is directly connected to a shaft of the movable vane 5.

The movable vane 5 is operative independently of the operations of the horizontal vane 3 and the vertical vane 4, and is capable of partly blocking the outlet portion of the outlet 2 so as to form the air passage 2*a* which converges air flowing in the direction of the arrows B to the central region of the outlet 2.

Figure 4:
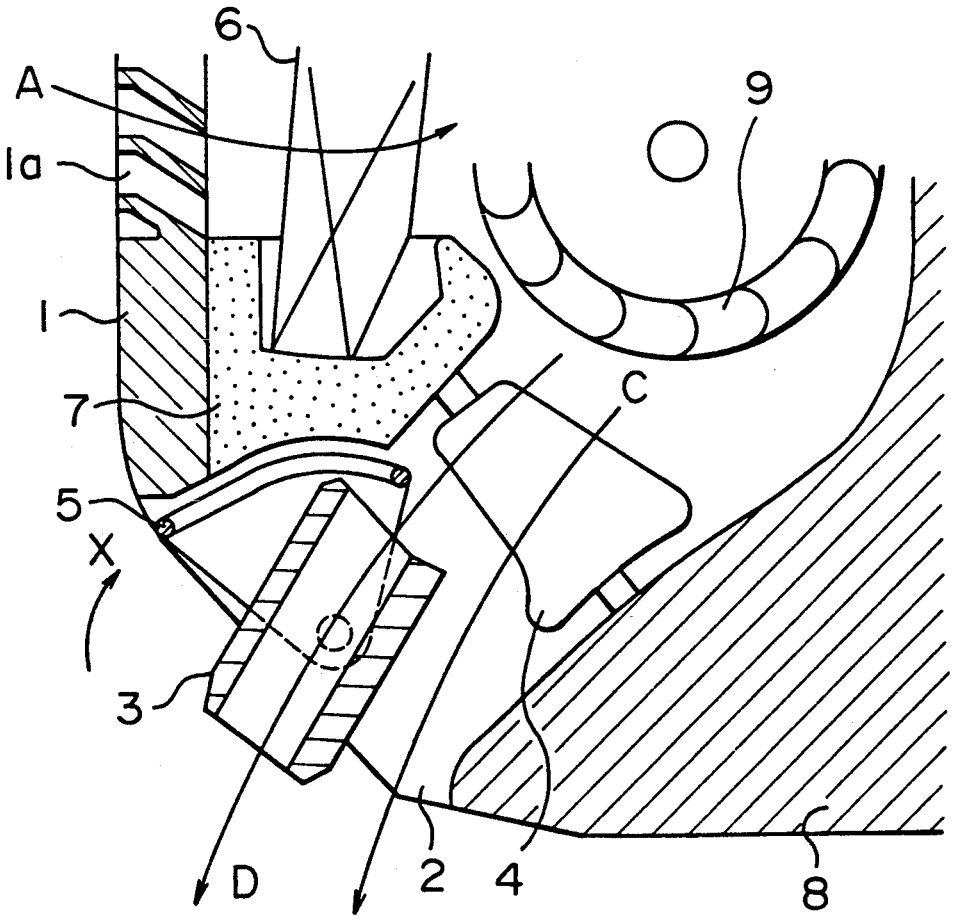
FIG. 4 is a sectional view taken along the line IV—IV of FIG. 3.

When the air is to be discharged over the entire breadth of the air outlet 2, the movable vane 5 is rotated in the direction of an arrow X and stopped at a position where the vane 5 does not interrupt the flow of the air discharged as indicated by arrows C and D in FIG. 4. The horizontal vane 3 and the vertical vane 4 are independently operable even in this state of operation.

Figure 5:
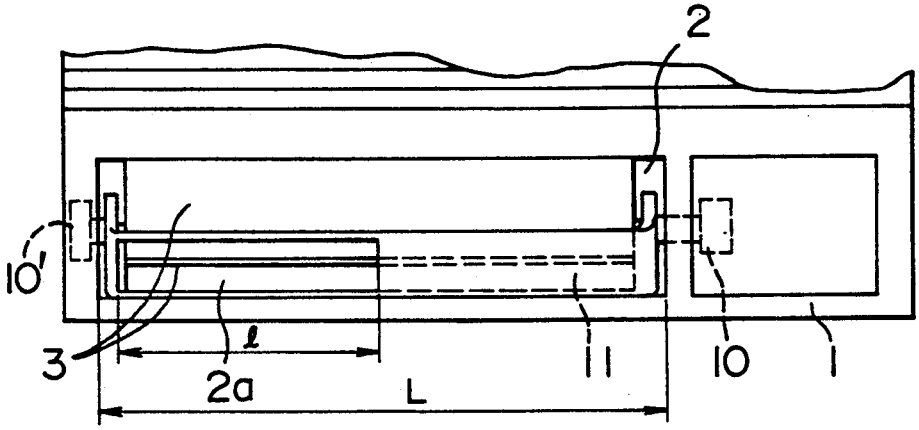
FIGS. 5, 6 and 7 are front elevational views of the room unit in different states of use.

FIG. 5 shows a modification which employs a movable vane 11 having an opening in its left half portion so that air is discharged from the left half part of the outlet 2 when the vane 11 is in the operative position.

Figure 6:
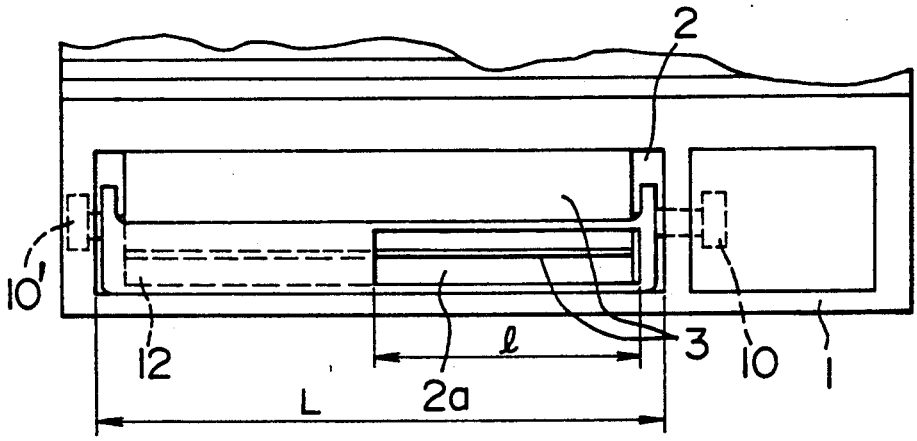

FIG. 6 shows another modification which employs a movable vane 12 having an opening in its right half portion so that air is discharged from the right half part of the outlet 2 when the vane 12 is in the operative position.

Figure 7:
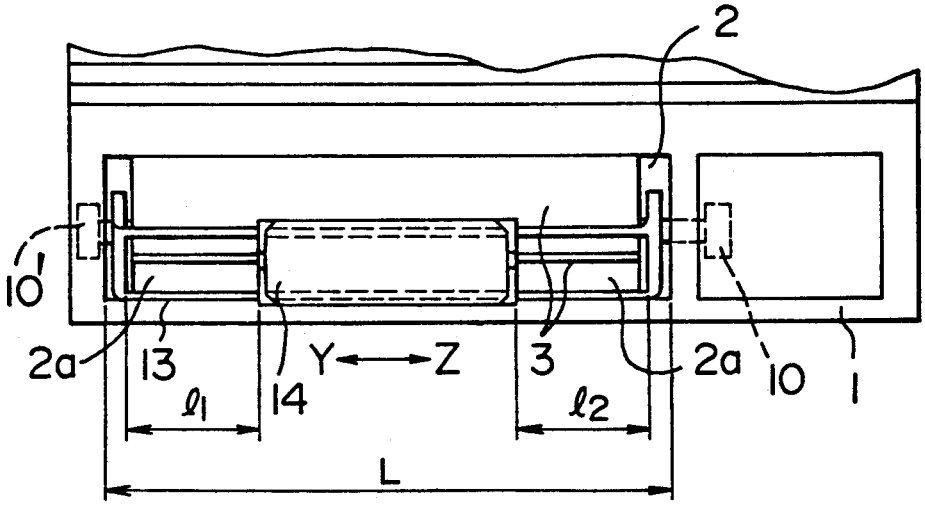

FIG. 7 shows a further modification in which the position of the air passage 2*a* can be set at any desired position along the breadth of the outlet 2.

More specifically, a shield plate 14 is provided for movement in the breadthwise direction of the outlet as indicated by arrows Y and Z along a guide frame 13 which extends over the entire breadth of the outlet so that air passages 2a are formed both in the left and right end portions of the outlet or only in the left or right parts of the outlet.

The shield plate 14 may include a plurality of segments so that the air passage 2a can be set at any desired position along the breadth of the outlet 2.

The advantage of this embodiment will be.

Figure 8:
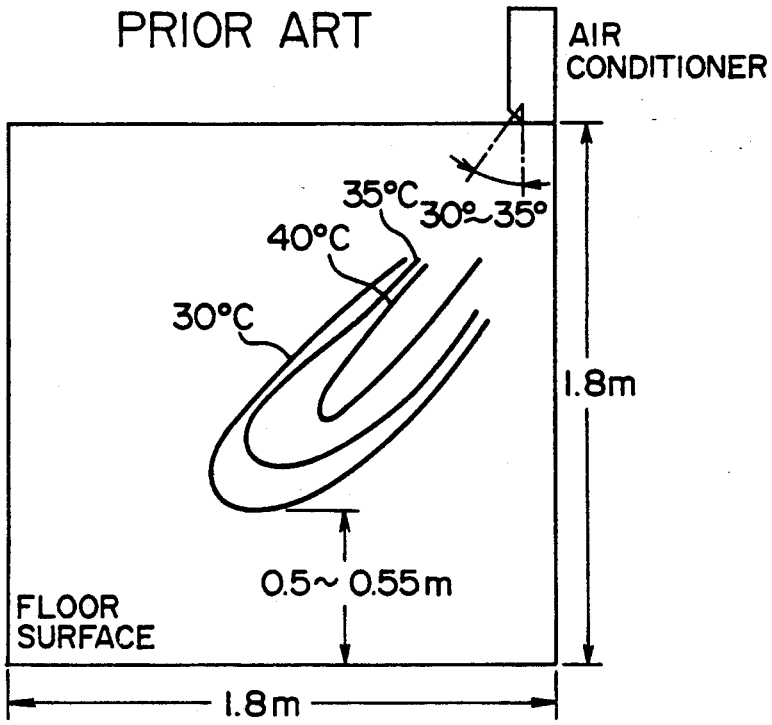
FIG. 8 PRIOR ART
FIG. 8 is a diagram showing temperature distribution of room air formed by air discharged from a known air conditioner.
Figure 9:
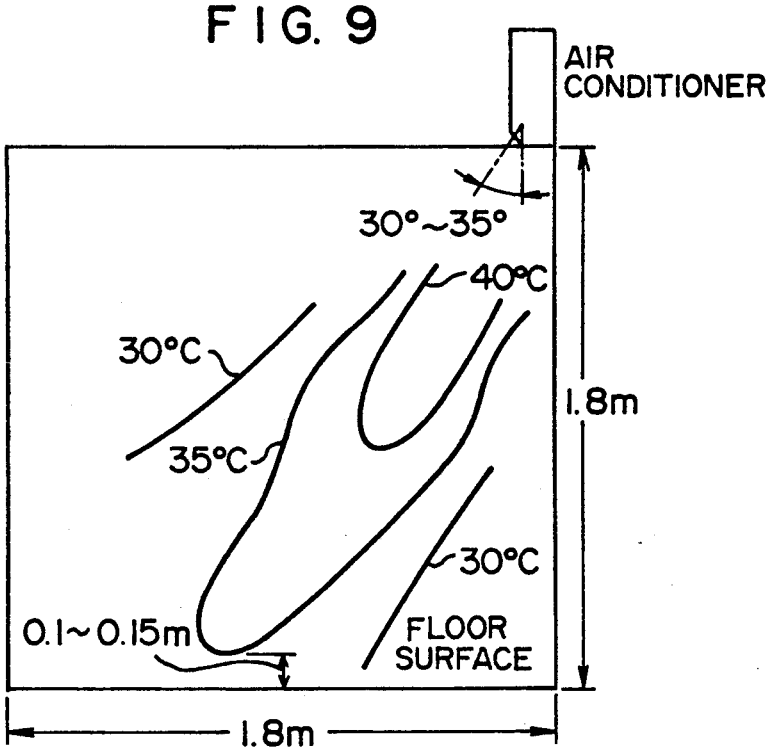
FIG. 9 is a diagram showing temperature distribution of room air formed by air discharged from the embodiment shown in FIG. 1.

FIG. 8 shows the temperature distribution of room air when heated by heated air discharged from a known air conditioner which is operating in heating mode and which delivers air at a low velocity. It will be seen that the air of 30° C. cannot reach a point beyond a level which is 0.5 to 0.55 m above the floor.

In embodiment of the air conditioner the present invention in a start-up condition, air of 30° C. reaches the floor surface and even air of 35° C. reaches a level which is 0.1 to 0.15 m above the floor surface. Thus, the area of the floor surface can be heated directly by the air blown from the air conditioner.

Figure 10:
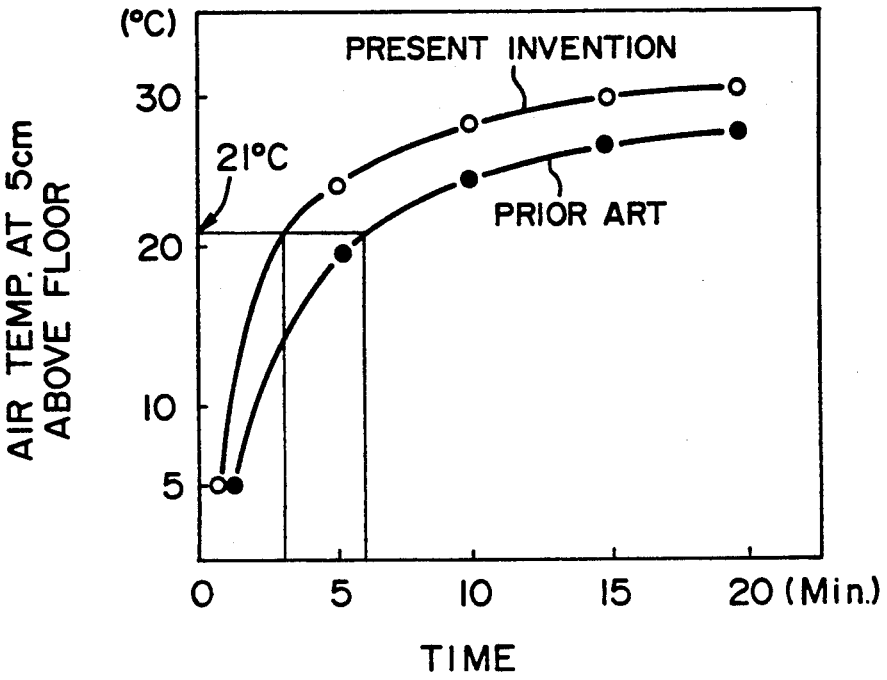
FIG. 10 is a graph showing the rise of air temperature in a region 5 cm above the floor in a heating-mode operation of the air conditioner.

FIG. 10 shows patterns of the rise of the room air temperature at a level 5 cm above the floor surface as achieved by the known air conditioner and by the described embodiment of the air conditioner of the present invention when the ambient air temperature outside the room was 5° C. It will be seen that, while the known air conditioner requires about six minutes to heat the room air up to 21° C., the air conditioner of the present invention can heat the room air to 21° C. in about three minutes.

It will be apparent that, once the room air is heated to the desired temperature, e.g., 21° C., the user can switch the air conditioner to a mode in which heated air is discharged gently at a moderate speed from the entire portion of the outlet 2.

It will be also apparent that a quick start-up is possible with the air conditioner of the present invention in a cooling mode. Once the aimed zone is cooled down to a desired temperature, the horizontal vane 3 is rotated to a substantially horizontal position so that cooled air is gently discharged.

A description will now be made of the opening ratio of the air passage. The opening ratio in this specification means the ratio l/L of the length l (FIG. 1) of the portion of the movable vane 5 defining the air passage 2a to the overall breadth L of the outlet 2. In the arrangement shown in FIG. 7, the length l is ($\square_1+\square_2$), where $l_1$ and $l_2$ represent the lengths of the regions defining the left and right air passages 2a, 2a, i.e., the regions which are not blocked by the shield plate 14.

Figure 11:
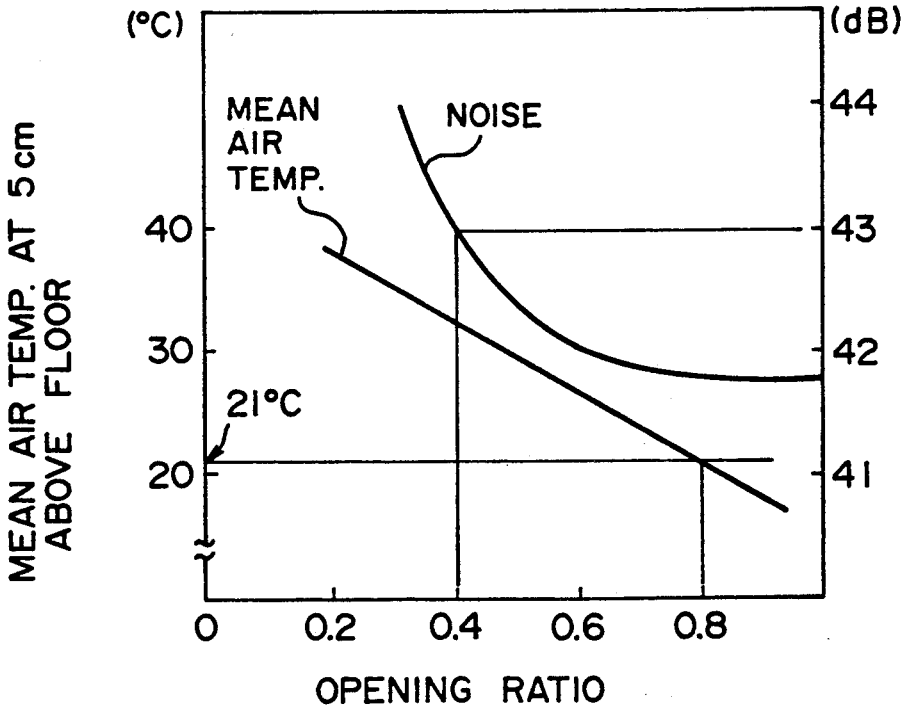
FIG. 11 is a graph showing the relationships of the degree of opening of the air outlet to mean air temperature at 5 cm above the floor and to the noise level.

FIG. 11 shows how the mean temperature (°C.) measured at a level 5 cm above the floor surface and the noise level (dB) are varied in relation to a change in the opening ratio l/L. It will be seen that the mean temperature at the level 5 cm above the floor surface becomes higher when the opening ratio l/L is decreased. A reduction in the opening ratio, however, is accompanied by a quadratic increase in the noise level. In order to attain a mean air temperature of 21° C. or higher while suppressing the noise to a level to not more than 43 dB in the zone 5 cm above the floor surface, the opening ratio should be set to range between 0.4 and 0.8, as shown in FIG. 11. However, taking a safety factor into account, preferably the opening ratio is in a range of between 0.65 and 0.75.

The horizontal vane 3 and the movable vane 5 may preferably be manually rotated or rotated by motors such as for example, stepper motors. A description will be made of an embodiment in which the horizontal vane 3 and the movable vane 5 are actuated by the independent motors 10 and 10' under the control of a microcomputer.

Figure 12:
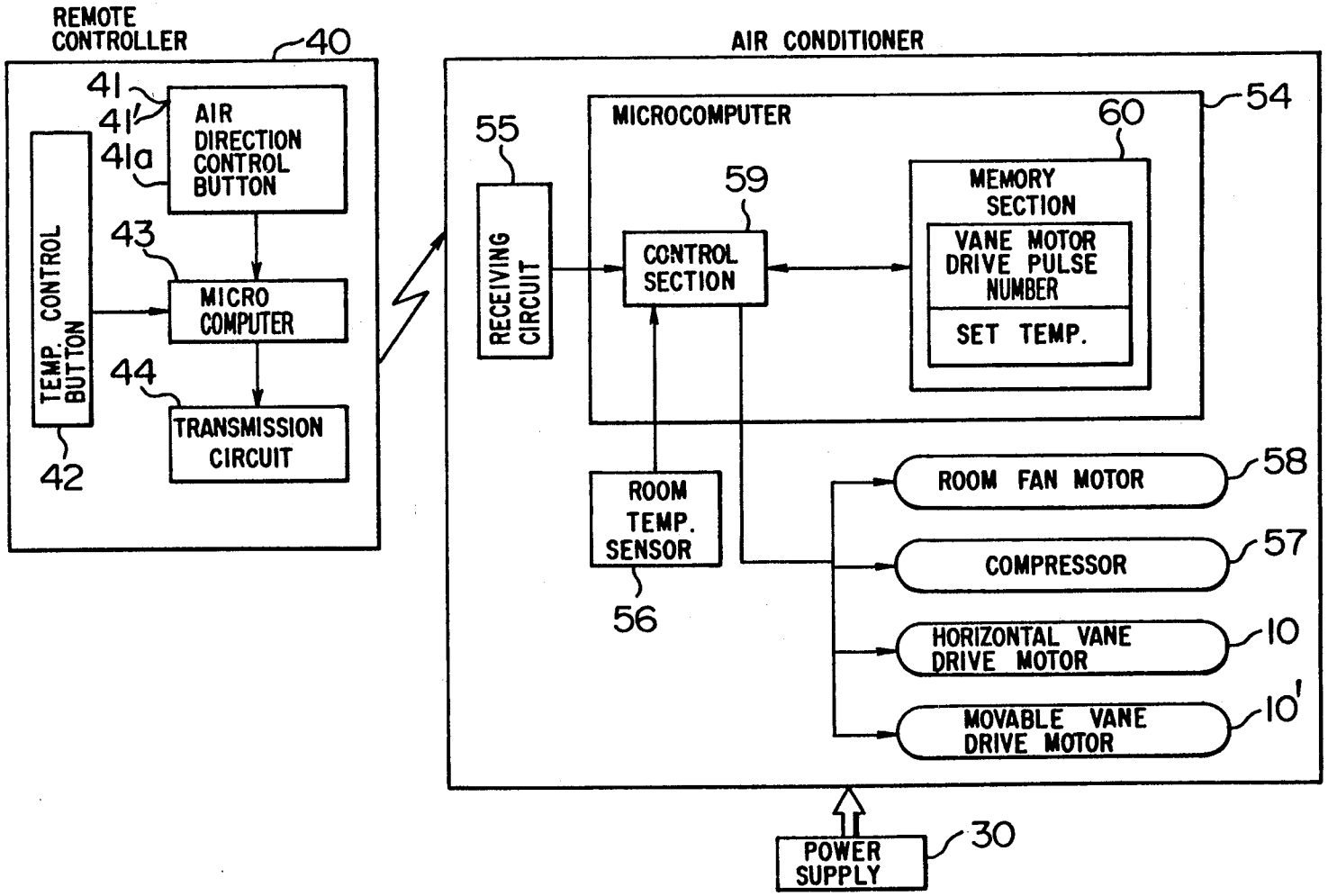
FIG. 12 is a block diagram of a control system for controlling the embodiment of the air conditioner.

The air conditioner shown in FIG. 1 is provided with a remote controller 40. As shown in FIG. 12, the remote controller 40 has air direction control buttons 41 and 41' for controlling the horizontal vane drive motor 10 and the vertical vane drive motor 10', a temperature control button 42 for changing the set temperature, and a microcomputer 43 for receiving and processing signals from these buttons so as to deliver a control signal to a transmission circuit 44.

The air conditioner itself includes a microcomputer 54, a receiving circuit 55 for receiving signal transmitted from the transmission circuit 44 of the remote controller 40, a room temperature sensor 56.

The microcomputer 54 has a control section 59 and a memory section 60 for storing data such as numbers of pulses supplied to the vane driving motors 10 and 10', a set temperature etc. The control section 59 receives data from the receiving circuit 55, room temperature sensor 56 and the memory section 60 and conducts various computations so as to deliver control signals to external devices such as a room fan motor 58, a compressor 57, the horizontal vane motor 10 and the movable vane motor 10'.

The remote control operation conducted through the remote controller 40 will be described with reference to FIGS. 12 and 13.

Figure 13:
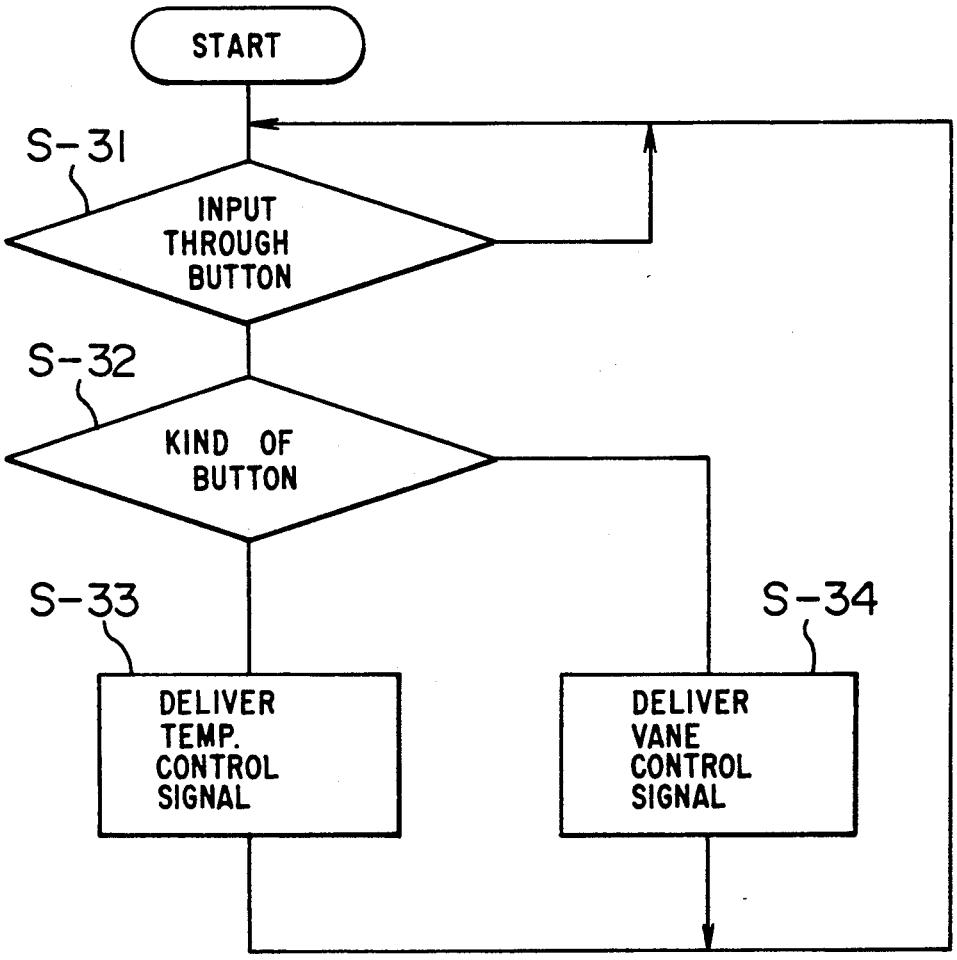
FIG. 13 is a flow chart illustrating a remote-control process.

In step S-31 shown in FIG. 13, the microcomputer 43 of the remote controller 40 monitors any input through the air direction control buttons 41 and 41', the temperature control button 42, and so forth. When an input is received, the microcomputer 43 determines, in step S-32, from what button the input was derived. When the input was done through the temperature control button 42, the microcomputer 43 delivers a temperature signal in step S-33. On the other hand, when the button is the air direction control button 41 or 41', the microcomputer 43 delivers a vane control signal in step S-34. In response to these signals, the horizontal vane 3 is rotated in the direction of an arrow V (FIG. 2) so as to be directed downwardly. The program is determined such that the movable vane 5 also is rotated in the direction of the arrow V into alignment with the rotated horizontal vane 3.

Figure 14:
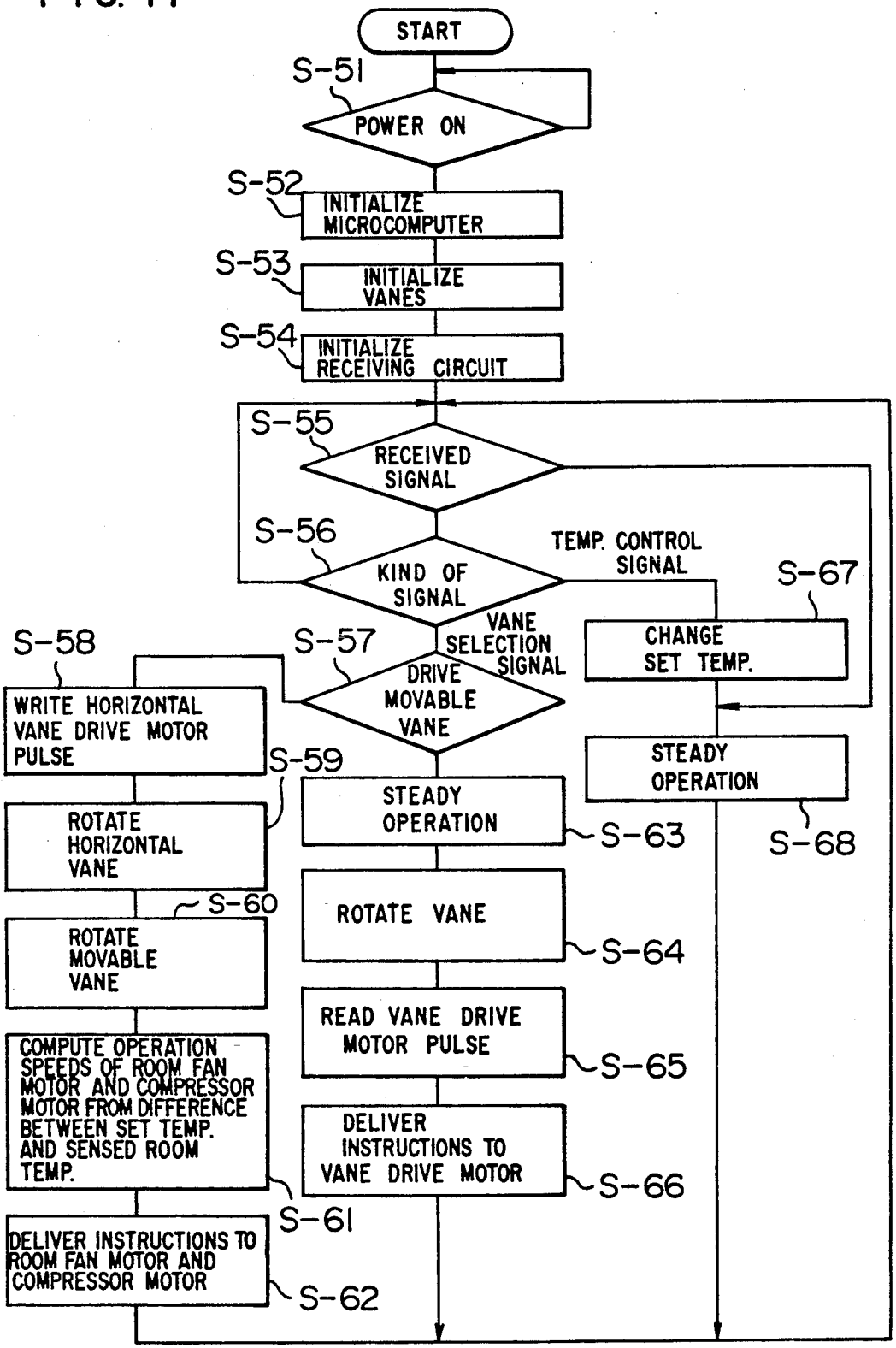
FIG. 14 is a flow chart illustrating the process of operation of the air conditioner.
Figure 15:
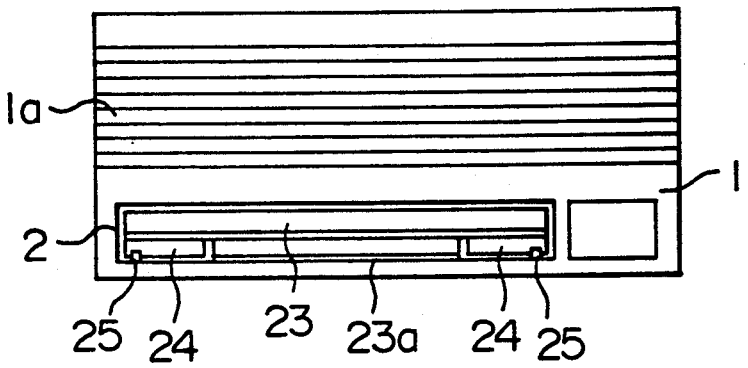
FIG. 15 is a front elevational view of a room unit of another embodiment of the air conditioner of the present invention.

The operation of the air conditioner itself will be described with reference to FIGS. 12 and 14.

When an on-state of the power supply 30 is confirmed in step S-51, step S-52 is executed in which an operation for initializing the microcomputer 54, initialization of the control section 59, clearing of the memory section 60 storing data such as the number of pulses supplied to the vane driving motors and set temperature, and so forth is conducted.

Subsequently, step S-53 is executed in which the horizontal vane 3 and the movable vane 5 are set to initial positions, e.g., to positions shown in FIG. 4, by initializing operations of the horizontal vane drive motor 10 and the movable vane drive motor 10'. The receiving circuit 55 is then initialized in step S-54.

After the initializing operations, the process proceeds a step S-55 which awaits any signal to be received by the receiving circuit 55. When signal is received, the kind of the signal is determined in a step S-56. When this signal is a vane selection signal, an operation is conducted to check the position of the movable vane 5 in step S-57. If the movable vane 5 has been rotated in the direction of the arrow W in FIG. 2, the number of pulses to be supplied to the horizontal vane drive motor is stored in the memory section 60 in step S-58. Subsequently, the horizontal vane 3 is rotated in the direction of the arrow V to the position shown in FIG. 2 in step S-59. Subsequently, the movable vane 5 is rotated in step S-60 to position where it is aligned with the downstream end of the horizontal vane 3. In this state, the horizontal vane, 3 and the movable vane 5 are inclined at 30° to 35° with respect to a vertical plane.

Subsequently, the speeds at which the room fan motor and the compressor are to be operated are computed based on the difference between the room temperature and the set temperature, and instructions corresponding to the computed operation speeds are fed to the room fan motor 58 and the compressor 57 in steps S-61 and S-62.

The computation of the operation speeds of the room fan motor 58 and the compressor 57 may be conducted by referring to a control table shown below.

Room-fan Motor Compressor Control Table

| | Temperatures when air direction control buttons are operated | Speed of room fan motor | Speed of compressor |
|---|---|---|---|
| Cooling | Room temp. > Set temp. | High | High |
| Cooling | Room temp. ≈ Set temp. | Low | High |
| Heating | Room temp. > Set temp. | High | Low |
| Heating | Room temp. ≈ Set temp. | Low | High |
| Heating | Room temp. < Set temp. | High | High |

When the vane selection signal is received while the movable vane 5 has been rotated in the direction of the arrow V to the position shown in FIG. 2, the air conditioner is not in the start-up condition, so that an instruction signal is given in step S-63 to reset the room fan motor 58 and the compressor 57 to ordinary operational states. Then, the movable vane 5 is rotated in the direction of an arrow X to the position shown in FIG. 4 in step S-64, and the number of pulses to be supplied to the horizontal vane drive motor stored in the memory section 60 in advance of the selection of the vane is read in step S-65. Then, an instruction signal is given to the horizontal vane drive motor 10 in step S-66.

However, when the signal questioned in step S-56 is a temperature signal, the process proceeds to step S-67 in which the temperature set in the memory section 60 is changed and, thereafter, normal operation of the air conditioner is executed in step S-68.

As will be seen from the foregoing description, the remote controller 40 enables the positions of the horizontal vane 3 and the movable vane 5 to be remotely controlled simply by pressing of the air direction control button 41 or 41', thus facilitating the operation of the air conditioner.

More specifically, when the air direction control button 41' is pressed, the movable vane 5 blocks the end portions of the outlet 2 so that most of the air discharged is concentrated to the central air passage 2a, whereas, when the air direction button 41 is pressed, the movable vane 5 is rotated to allow the entire part of the outlet 2 to open so that the air is blown through the entire portion of the outlet 2.

Thus, in the above described embodiment of the invention, the movable vane 5 is movable to a position where it closes left and right end portions of the outlet 2 so as to concentrate the flow of the conditioned air to the breadthwise central portion of the outlet 2. Therefore, when the discharge rate is unchanged, the velocity of air is increased substantially in inverse proportion to the reduction in the discharge area of the outlet.

It is also possible to block the right and left parts of the outlet 2 by using the movable vanes 11 and 12, respectively.

When a shield plate, composed of a plurality of segments and slidable along the guide frame 13, is used, it is possible to concentrate the air flow to any desired breadthwise portion or portions of the outlet 2.

Referring to FIGS. 15 and 16 and FIGS. 18 and 19, an air conditioner has a main vane 23 capable of variably deflecting air discharged from the outlet 2, a first auxiliary blade 23a integral with the main vane 23, and a pair of second auxiliary vanes 24 which are separately disposed on both lateral sides of the first auxiliary vane 23a. More specifically, the second auxiliary vanes 24 are disposed at positions where they are substantially co-planar with the first auxiliary vane 23a when the first auxiliary vane 23a integral with the main vane 23 is in the position shown in FIG. 18 but are set to form an angle with respect to the planes of the main vane 23 and the first auxiliary vane 23a when the main vane 23 and the first auxiliary vane 23a are rotated in a predetermined direction.

A projection 25 serving as a stopper limits the rotation of each second auxiliary vane 24, and the main vane 23 includes a rotary shaft 26.

Figure 16:
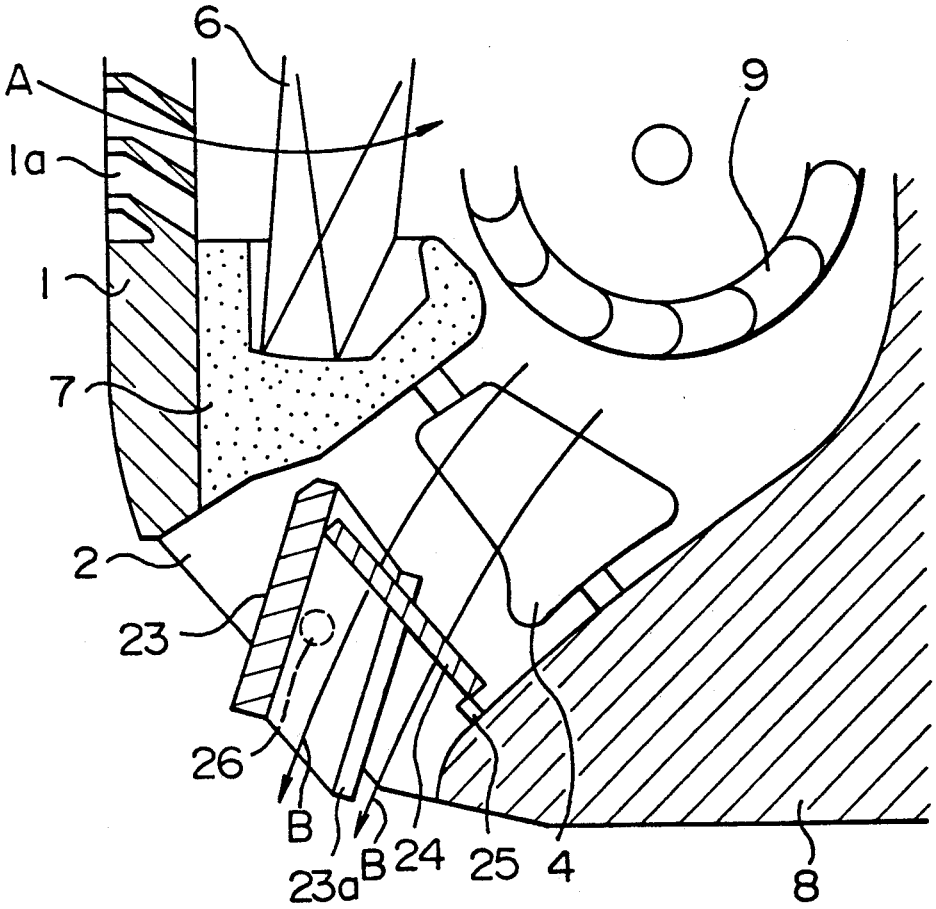
FIG. 16 is a fragmentary enlarged sectional view of the unit shown in FIG. 15.
Figure 17A:
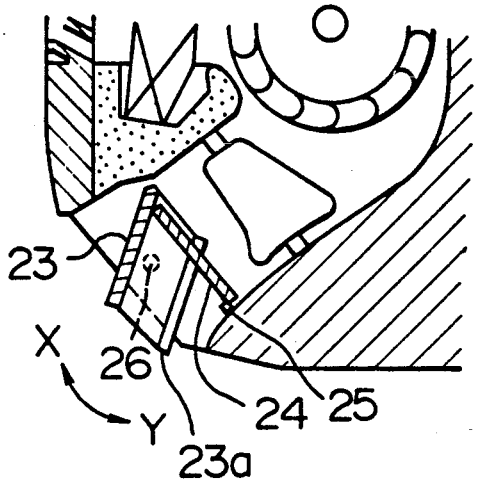
FIGS. 17A to 17D are fragmentary sectional views of the unit shown in FIG. 15 illustrative of the mechanism for rotating vanes shown in FIG. 16.
Figure 17B:
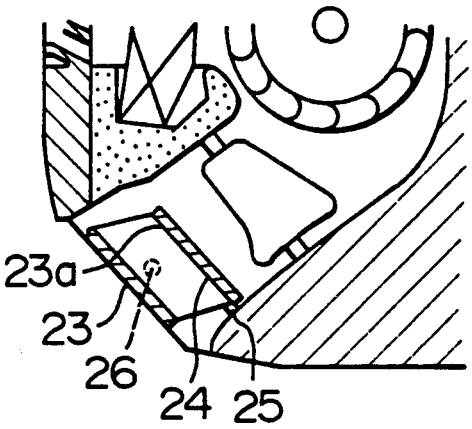
Figure 17C:
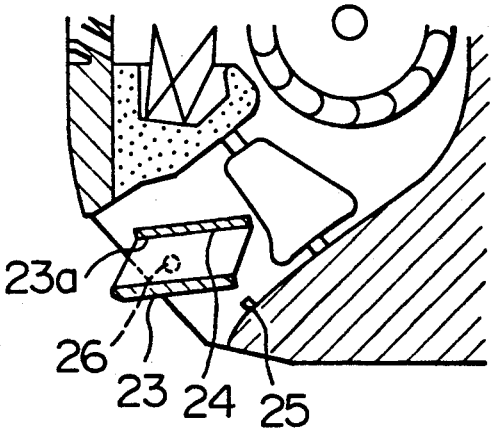
Figure 17D:
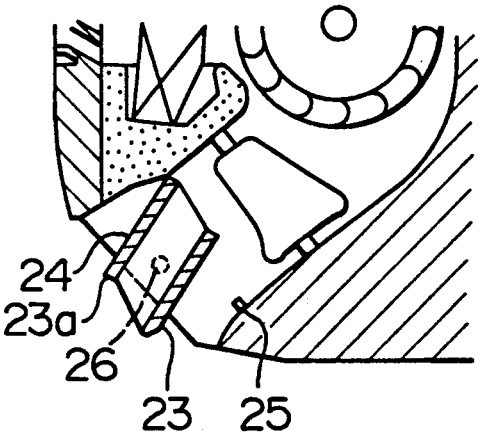

Referring to FIG. 17A, when the main vane 23 is rotated in the direction of an arrow X, the first auxiliary vane 23a is rotated together with the main vane 23 to the same angular position as the main vane 23. However, the second auxiliary vanes 24 remain in the illustrated position because they are stopped by the projections 25. In this state, the second auxiliary vanes 24 block the associated portions of the air outlet. When the main vane 23 is rotated in the direction of an arrow Y, the outlet 2 is blocked over the entire breadth thereof, shown in FIG. 17B. Ordinary operation in air supplying mode, cooling mode or heating mode can be conducted with the vanes rotated as shown in FIGS. 17C and 17D. It will be seen that the completely blocked state shown in FIG. 17B and the partly blocked state shown in FIG. 17A can be obtained by reversing the main vane 23. The second vanes 24 are set in a plane different from the plane of the first auxiliary vane 23a as shown in FIGS. 16 and 17A only when the main vane 23 is rotated in the direction of the arrow X. When the main vane 23 and the first auxiliary vane 23a are rotated in the direction of the arrow Y from the position shown in FIG. 17A to the position shown in FIG. 17B, the first auxiliary vane 23a becomes co-planar with the second auxiliary vane 24 and, thereafter, the second auxiliary vanes 24 are rotated while keeping the same plane as the main vane 23 and the first auxiliary vane 23a about the common axis of rotation provided by a shaft 26. This operation of the second auxiliary vanes 24 is effected by a mechanism which will be described in connection with FIGS. 18 and 19.

Figure 18:
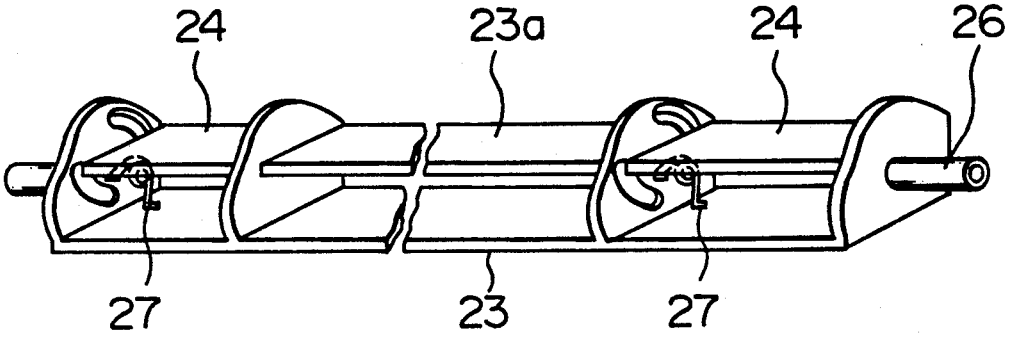
FIGS. 18 and 19 are perspective views of vanes used in the embodiment shown in FIG. 15.
Figure 19:
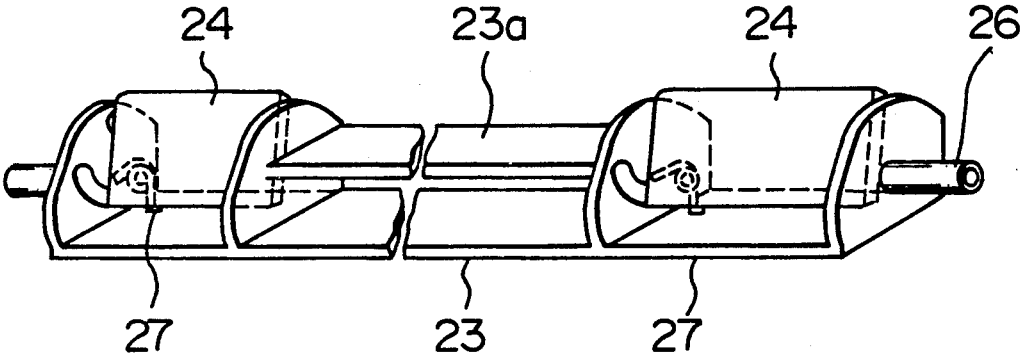

Most particularly, as shown in FIGS. 18 and 19, a spring 27 is installed to act between each auxiliary vane 24 and the adjacent end of the main vane 23. The spring 27 resiliently biases the associated auxiliary vane 24 to maintain the same co-planar with the first auxiliary vane 23a when the main vane is rotated in the direction opposite to the aforementioned predetermined direction beyond the position shown in FIG. 17B, i.e., when no force is applied to the second auxiliary vane 24.

Figure 20:
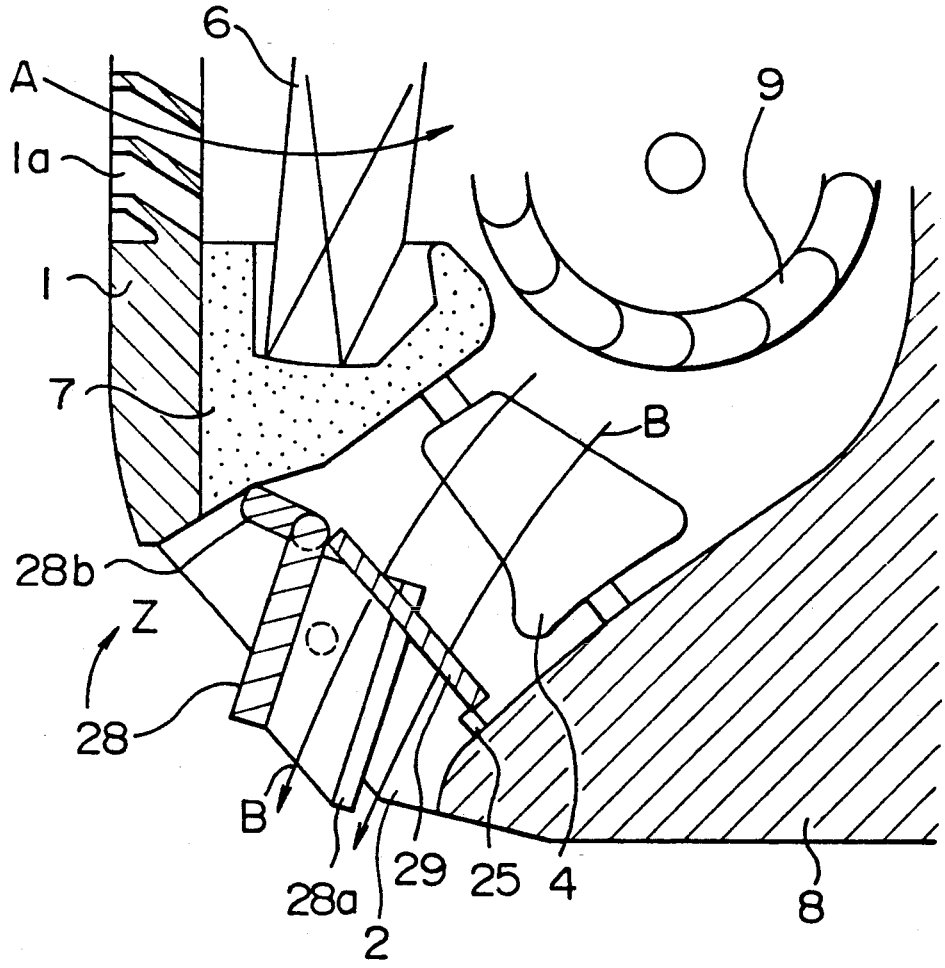
FIG. 20 is a sectional view of a portion of a room unit of still another embodiment of the air conditioner of the present invention.

Referring to FIG. 20, the air conditioner has a main vane 28 capable of variably deflecting the discharged air in the vertical direction, a first auxiliary vane 28a integral with the main vane 28 and second auxiliary vanes 29 which are provided on both sides of the first auxiliary vane 28 separately therefrom. A pivot vane 28b is provided on one horizontal edge of the main vane 28 so as to extend in the direction of the breadth of the outlet 2. The pivot vane 28b is pivotable on the main vane 28 so as to form an angle with respect to the main vane 28 only when the main vane 28 is rotated in the direction of an arrow Z. When the main vane 28 is rotated in the opposite direction, the pivot vane 28b again becomes copolanar with the main vane 28.

In the embodiment FIG. 20, the second auxiliary vanes 29 block both breadthwise end portions of the outlet 2 only when the main vane 28 is rotated in the direction of the arrow Z, so that the discharged air is concentrated to the central region, whereby the velocity of the discharged air is increased when the discharge rate is unchanged. The second auxiliary vanes 29 are spring-biased so that they can be reset to the state coplanar with the first auxiliary vane 28 when no external force is applied to these second auxiliary vanes 29. Furthermore, when the main vane 28 is rotated in the direction of the arrow Z so as to concentrate the air to the breadthwise central region of the outlet 2, the pivot vane 28b on the main vane 28 is contacted with the drain pan 7 as shown in FIG. 20 so as to eliminate any gap therebetween, whereby the effect of the concentration of air to the breadthwise central region is enhanced.

Figure 21:
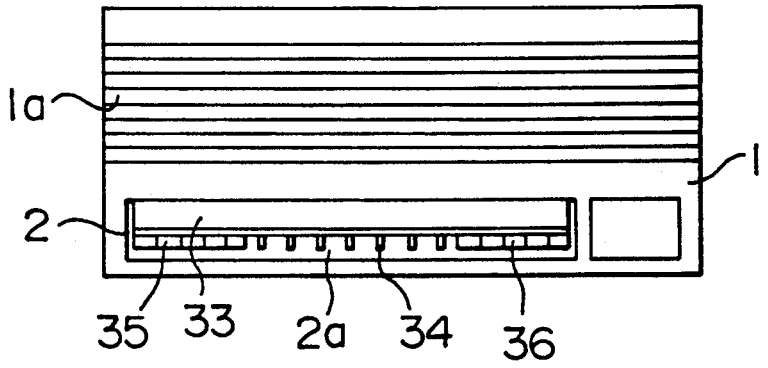
FIG. 21 is a front view of a room unit of a further embodiment of the air conditioner of the present invention.
Figure 22:
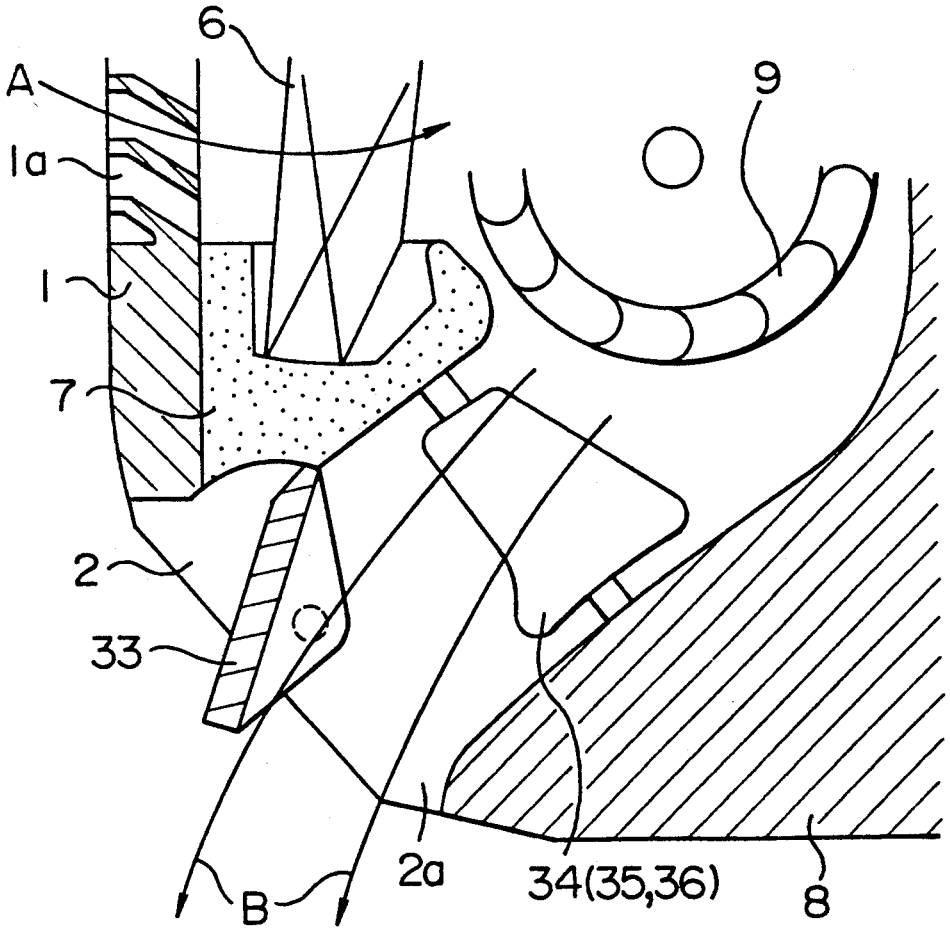
FIG. 22 is a fragmentary enlarged sectional view of the unit shown in FIG. 21.

The embodiment of the air conditioner of FIGS. 21 and 22 includes a horizontal vane 33 extending over the entire breadth of the outlet 2 and capable of variably deflecting the discharged air in the vertical direction. The air conditioner also has vertical vanes 34, 35 and 36 which are capable of variably deflecting the flow of the discharged air in horizontal directions. These vanes 33 to 36 in cooperation form an air direction changing means.

Figure 23:
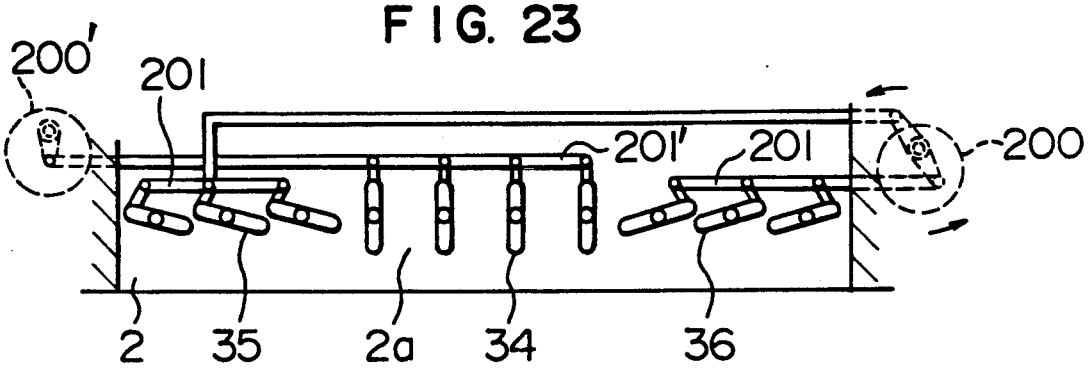
FIGS. 23, 24 and 25 are enlarged sectional views of an air outlet of the unit shown in FIG. 21.

Referring to FIG. 23, the vertical vanes 34 are operatively connected to a motor 200' by a linkage 201' and oriented to extend in a direction perpendicular to the plane of the outlet 2 so as to form passages for the discharged air, while the vertical vanes 35 and 36 are operatively connected to another motor 200 by linkages 201 and so set as to block the left and right end portions of the outlet 2. The group of vertical vanes 35 and the group of vertical vanes 36 are driven differently from each other. In the state shown in FIG. 23, both sets of the vertical vanes 35 and 36 are inclined in such a manner as to direct their lower ends generally towards the central vertical vanes 34.

Figure 24:
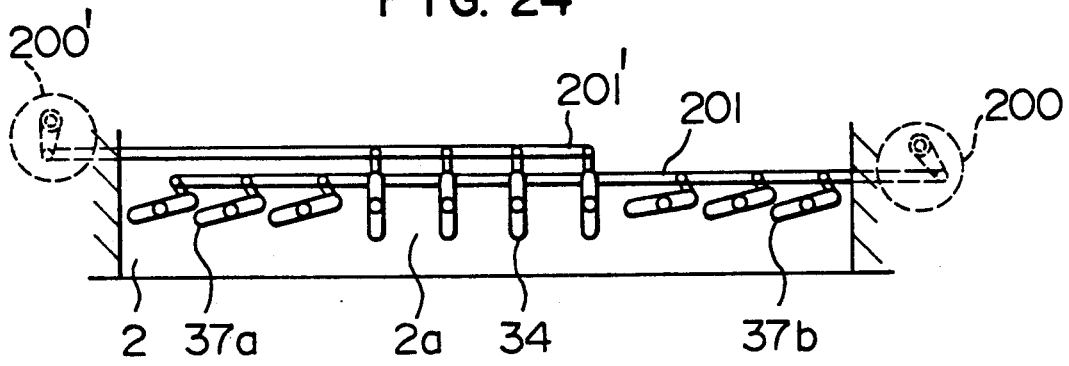

FIG. 24 shows a modification in which the vertical vanes 34 in the breadthwise central region of the outlet 2 are oriented so as to form air passages, whereas the left and right end portions of the outlet 2 are blocked by groups of vertical vanes 37a and vertical vanes 37b, respectively. In this modification, the vertical vanes 37a and the vertical vanes 37b are operatively connected by a linkage 201 and actuated by a common motor 200.

Figure 25:
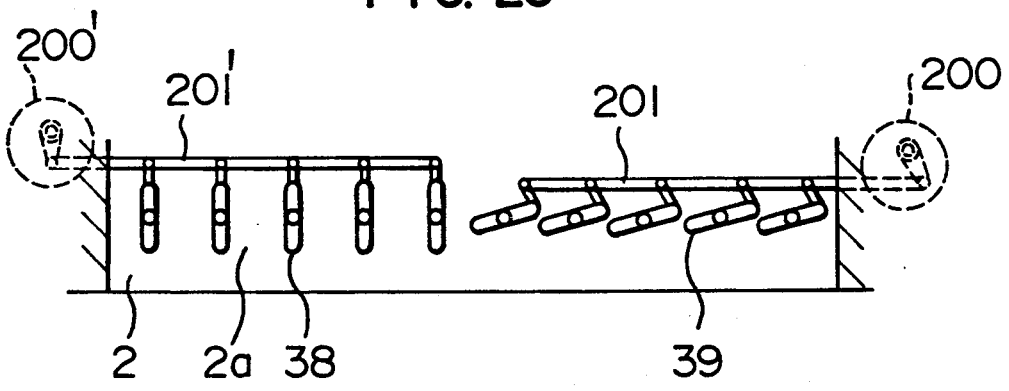

In FIG. 25, two groups of vertical vanes 38 and vertical vanes 39 are operable independently of each other by motors 200 and 200' and linkages 201 and 201' so as to form air passage 2a selectively in the left half or the right half of the outlet 2.

In this embodiment, therefore, a plurality of groups of vertical vanes are selectively operable to partly block the outlet 2 to thereby form an air passage 2a in a selected breadthwise region of the outlet 2. The air blocked by the vertical vanes is forced to flow through the air passage 2a, whereby the air is concentrated to the air passage 2a. As in the cases of the preceding embodiment, therefore, the velocity of the discharged air is increased in accordance with the reduction in the cross-sectional area of the air passage 2a. In the arrangements shown in FIGS. 23 to 25, vertical vanes of the same group are operatively connected together so as to be actuated simultaneously, thus realizing an inexpensive construction.

Although not described, the air conditioner control system and the remote controller described in connection with the first embodiment can be used also in the embodiments described in connection with FIGS. 15 to 25, as will be apparent to those skilled in the art.

Figure 26:
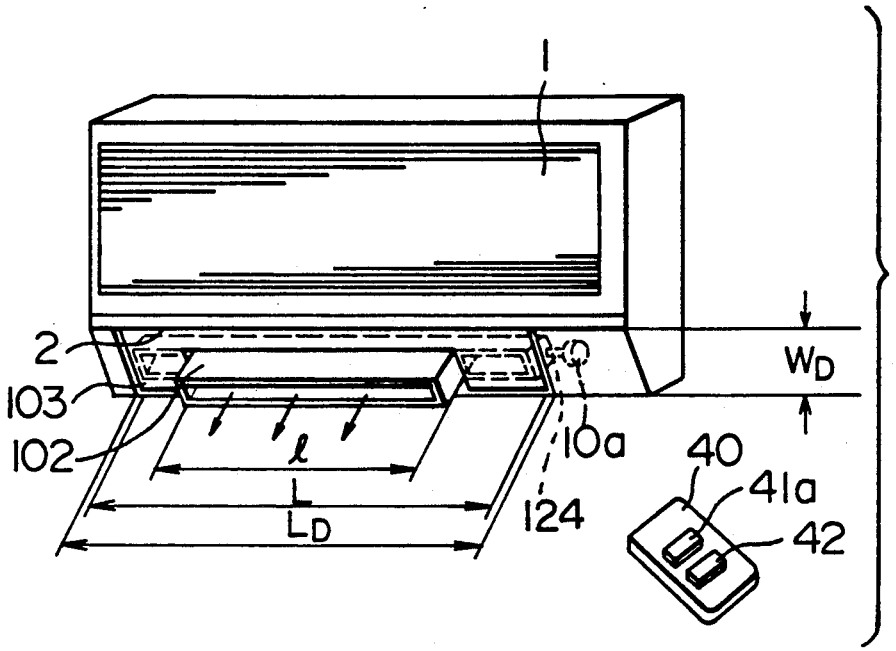
FIGS. 26 is a perspective view of a room unit and a remote controller of a still further embodiment of the air conditioner in accordance with the present invention.
Figure 27:
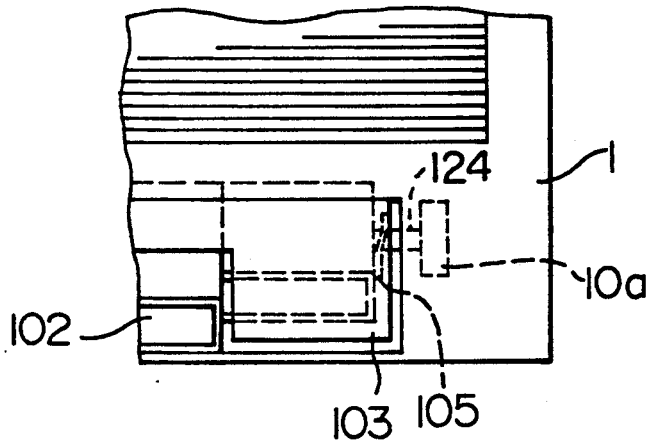
FIG. 27 is a fragmentary enlarged front elevational view of the unit shown in FIG. 26.

Referring first to FIG. 26, a substantially rectangular outlet 2 is formed in a lower part of a front cover of the air conditioner. The outlet 2 has a horizontal length or breadth $L_D$ and a vertical width or height $W_D$. It will be seen that a main deflector 102 and an auxiliary deflector 103 are disposed so as to be able to close the central region and both breadthwise end regions of the outlet 2, respectively. The cooperating main and auxiliary deflectors 102 and 103 form a deflector unit. Both the main and auxiliary deflectors 102 and 103 are rotatable independently of each other about a longitudinal axis of a horizontal trunnion shaft 124. More specifically, it is possible to rotate the main deflector 102 alone in a clockwise direction as viewed in FIG. 26 about the axis of the horizontal trunnion shaft 124 so as to partly open the outlet 2 while leaving the auxiliary deflector 103 in the blocking position. In this state, the outlet 2 is opened only over a horizontal length or breadth l of the main deflector 102 which is smaller than the breadth L of the auxiliary deflector 103, so that the air passage is restricted. Conversely, when the auxiliary deflector 103 and the main deflector 102 are rotated as a unit in a counter-clockwise direction as viewed in FIG. 26, about the axis of the trunnion shaft 124 the outlet 2 is fully opened so that the air is allowed to be discharged through the entire breadthwise portion of the outlet 2, whereby a greater cross-sectional area of the air passage is obtained.

Figure 31:
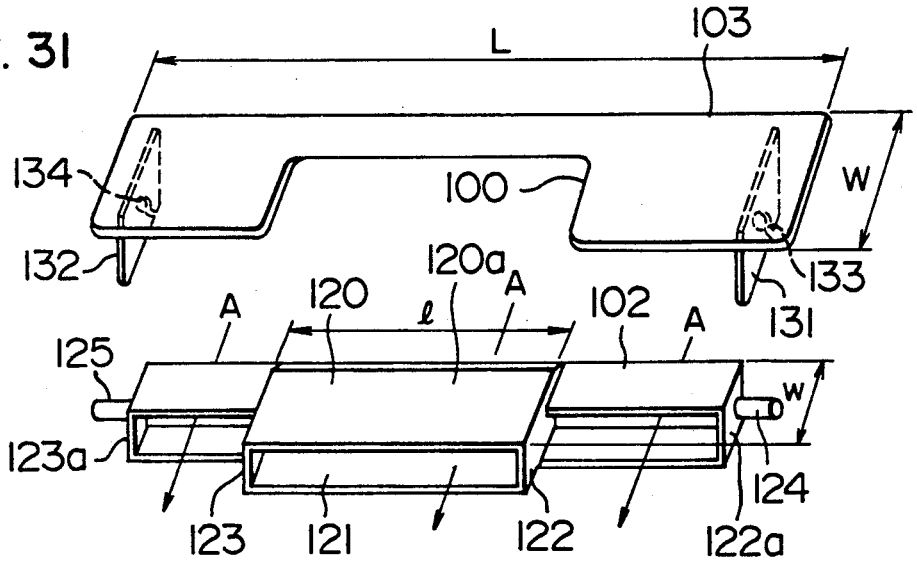
FIG. 31 is a schematic exploded perspective view of the air deflector.

Referring to FIG. 31, the main deflector 102 has a substantially rectangular tubular portion 120a formed of front and rear panels 120, 121 and both side panels 122 and 123, as well as both tubular wing portions having side walls 122a and 123a and disposed on both lateral sides of the tubular portion 120a. Air is allowed to pass through the central tubular portion 120a and both tubular wing portions as indicated by arrows A. Trunnion shafts 124 and 125 are provided on both end plates 122a and 123a. One or both of these trunnion shafts are suitably driven to rotate the main deflector 102 about the axis of the trunnion shafts 124 and 125.

The auxiliary deflector 103 has a central notched portion 100 capable of receiving the central tubular portion 120a of the main deflector 102 and is shaped to fit on the upper and both lateral sides of the central tubular portion 120a. The breadth L and the height W of the auxiliary deflector 103 are substantially the same as those of the outlet 2 formed in the front panel of the air conditioner. The auxiliary deflector 103 is provided at its both end portions thereof with supporting plates 131 and 132. These supporting plates 131 and 132 are provided with apertures 133 and 134 for receiving the trunnion shafts 124 and 125 of the main deflector 102.

Figure 28:
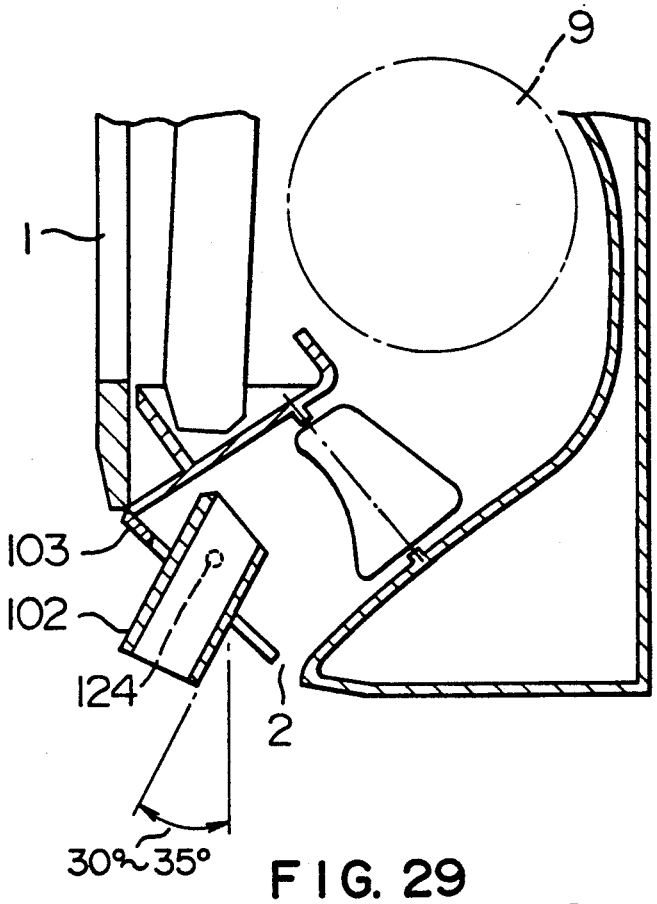
FIGS. 28, 29 and 30 are sectional side elevational views of an air deflector of the unit of FIG. 21 shown in different states.
Figure 29:
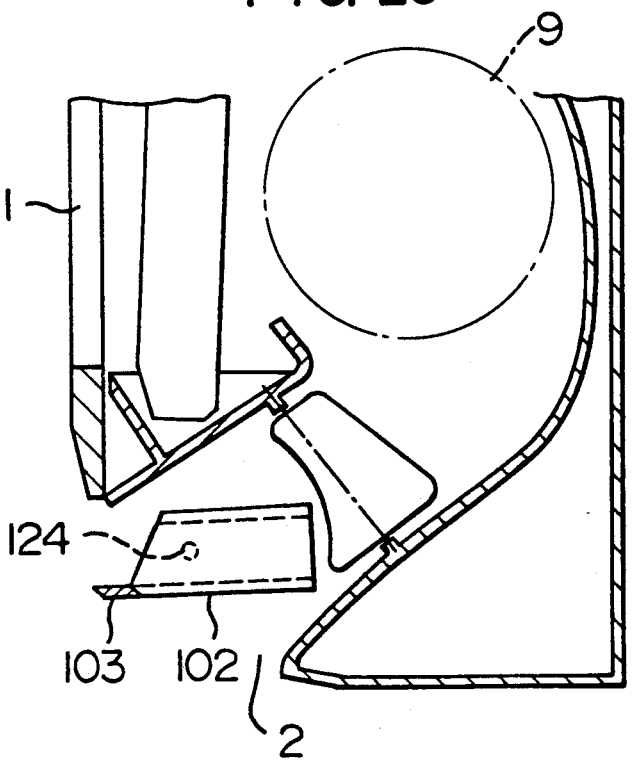
Figure 30:
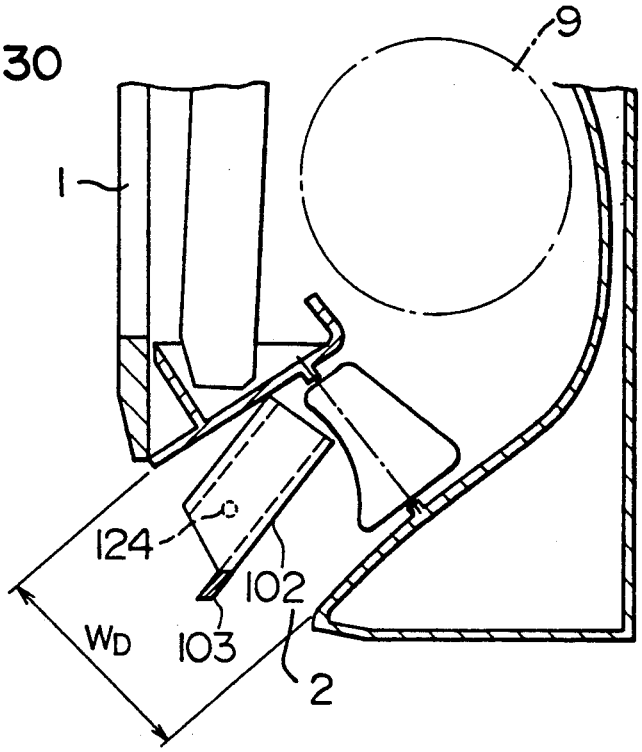
Figure 32:
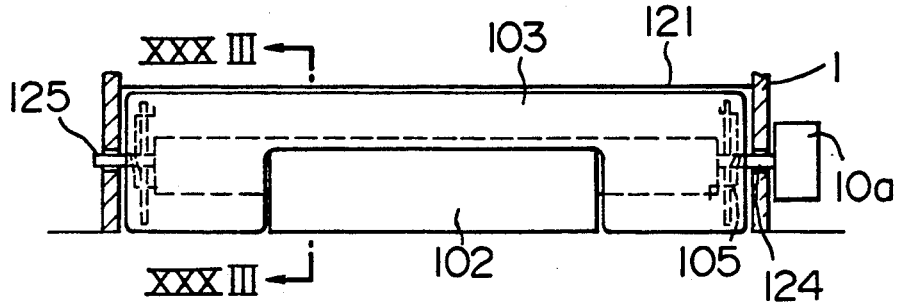
FIG. 32 is a front elevational view of the air deflector in assembled state.
Figure 33A:
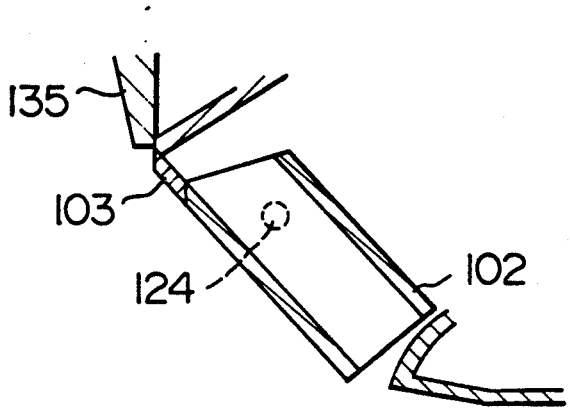
FIGS. 33A to 33D are sectional views taken along the line XXXIII—XXXIII of FIG. 32, illustrative of operation of the air deflector.
Figure 33B:
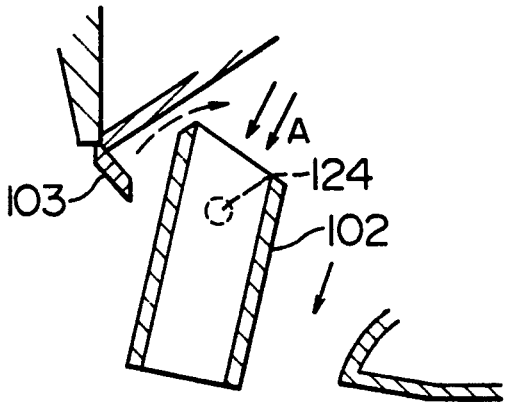
Figure 33C:
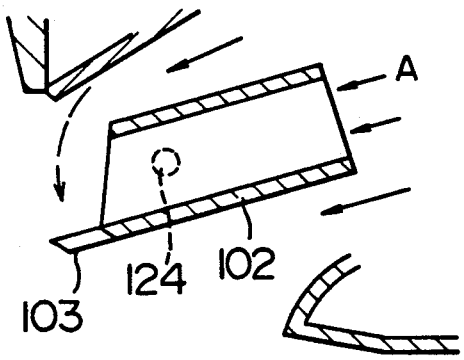
Figure 33D:
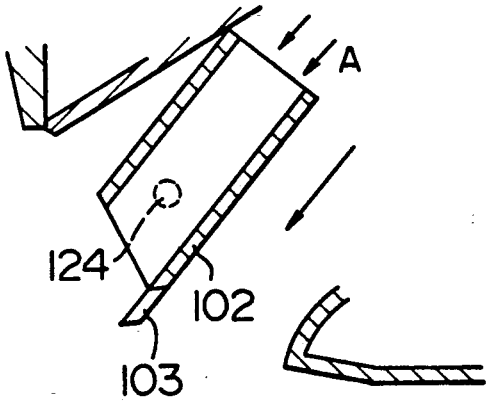

As schematically shown in FIG. 32, the trunnion shafts 124 and 125 of the main deflector 102 extend outwardly through the apertures 133 and 134 formed in the supporting plates 131 and 132 of the auxiliary deflector 103 so as to be journaled by a casing of the air conditioner. The main deflector 102 and the auxiliary deflector 103 are connected to each other by springs 105 so that the main deflector 102 and the auxiliary deflector 103 rotate as a unit when the trunnion shaft 124 is driven unless any external force is applied. In the state shown in FIG. 32, the outlet 2 is substantially completely closed by the main deflector 102 and the auxiliary deflector 103. In this state, a part of the auxiliary deflector 103 engages with a stopper 135 which is formed of, for example, a part of the casing, as shown in FIG. 33A. A clockwise rotation of the trunnion shaft 124 from the position shown in FIG. 33A causes the main deflector 102 alone to rotate in a clockwise direction while the auxiliary deflector 103 remains in the same position because it is stopped by a stopper member 135, as shown in FIG. 33B. In this state, major portions of the outlet 2 are closed by the auxiliary deflector 103 so that air is allowed to flow mainly through the central tubular portion 120a of the main deflector 102, as indicated by arrows A. In this state, therefore, a high air velocity is obtained to provide a long reach of the conditioned air. It is therefore possible to quicken the start-up of the air conditioning of a room when the deflector unit is set in the state shown in FIG. 33B. FIG. 33C shows a state in which the trunnion shaft 124 and, hence, the main deflector 102 have been rotated in a counter-clockwise direction from the position shown in FIG. 33A. In this case, the auxiliary deflector 103 is allowed to follow the rotation of the main deflector 102 by virtue of the springs 105. In the state shown in FIG. 33C, therefore, the outlet 2 is fully opened to allow the air to be discharged at a moderate velocity so as to gently cool or heat the air in the room. FIG. 33D illustrates a state in which the main deflector 102 and the auxiliary deflector 103 have been further rotated counter-clockwise to a position where these deflectors direct the discharged air toward a lower zone in the room. The state shown in FIG. 33D is therefore suitable for ordinary heating operation of the air conditioner. FIGS. 28, 29 and 30 show the states of the outlet section of the air conditioner described in connection with FIGS. 31 to 33D. In the state shown in FIG. 28, the auxiliary deflector 103 is held in contact with a portion of the casing, while the main deflector 102 has been rotated in a clockwise direction to a position where it forms an angle of from 30° to 35° with respect to a vertical plane. In this state, a large velocity of the discharged air is obtained to allow the discharged air to reach a zone near the floor surface, thus achieving a quick start-up of the air conditioning of the room. FIG. 29 shows a state in which the main deflector 102 and the auxiliary deflector 103 have been rotated in a counter-clockwise direction to fully open the outlet 2 so that the air is blown substantially horizontally from the air conditioner. Thus, the state shown in FIG. 29 is suitable for a steady cooling operation of the air conditioner. In the state shown in FIG. 30, the main and auxiliary deflectors 102 and 103 have been rotated to direct the air to a lower zone of the room. Thus, the state shown in FIG. 30 is suitable for a steady heating mode of the air conditioner. The driving of the trunnion shaft 124 may be effected by a motor such as a motor 10a shown in FIG. 26, although the main deflector 102 may be directly manipulated by a hand.

A description will be made of a case where the main deflector 102 is driven by a motor such as the motor 10a under the control of a microcomputer.

Figure 34:
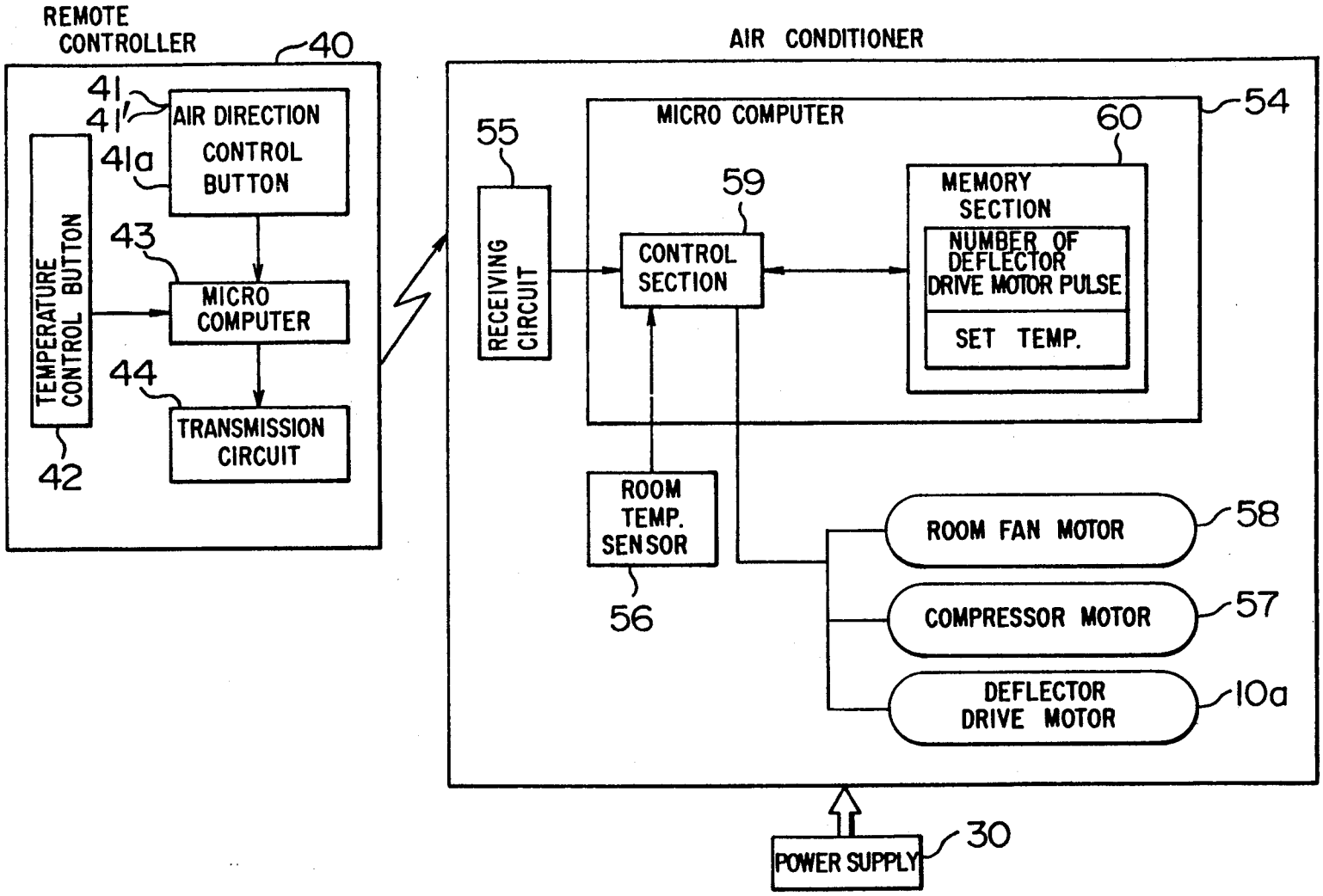
FIG. 34 is a block diagram of a control system for controlling the still further embodiment of the air conditioner of the present invention.

As shown in FIG. 26, this embodiment of the air conditioner has a remote controller 40 which has, as shown in FIG. 34, an air direction control button 41a for controlling the motor 10a for driving the deflector unit, a temperature control button 42 for changing the set temperature and a microcomputer 43 for conducting required arithmetic operations in response to signals input through these buttons so as to deliver a control signal to an output circuit 44. The air conditioner itself is also provided with a microcomputer 54. Thus, the construction is basically the same as that shown in FIG. 12 except that only one motor 10a is used to drive the deflector.

The operation of this embodiment will be described with reference to a flow chart shown in FIG. 35. As in the case of the operation of the first embodiment described in connection with FIG. 13, the microcomputer 43 monitors the state of input from the buttons 41a and 42 and, when an input is received, determines from which button the input was received. If the signal is from the temperature control button 32, the microcomputer delivers a temperature control signal. Conversely, when the signal is from the air direction control button 41a, the microcomputer 43 delivers a deflector separation signal. A program has been formed such that the deflector separation signal causes the main and auxiliary deflectors to be separated from each other if these deflectors have not been separated yet, whereas, if these deflectors have been separated, these deflectors are again jointed to resume the initial air discharge angle.

Figure 35:
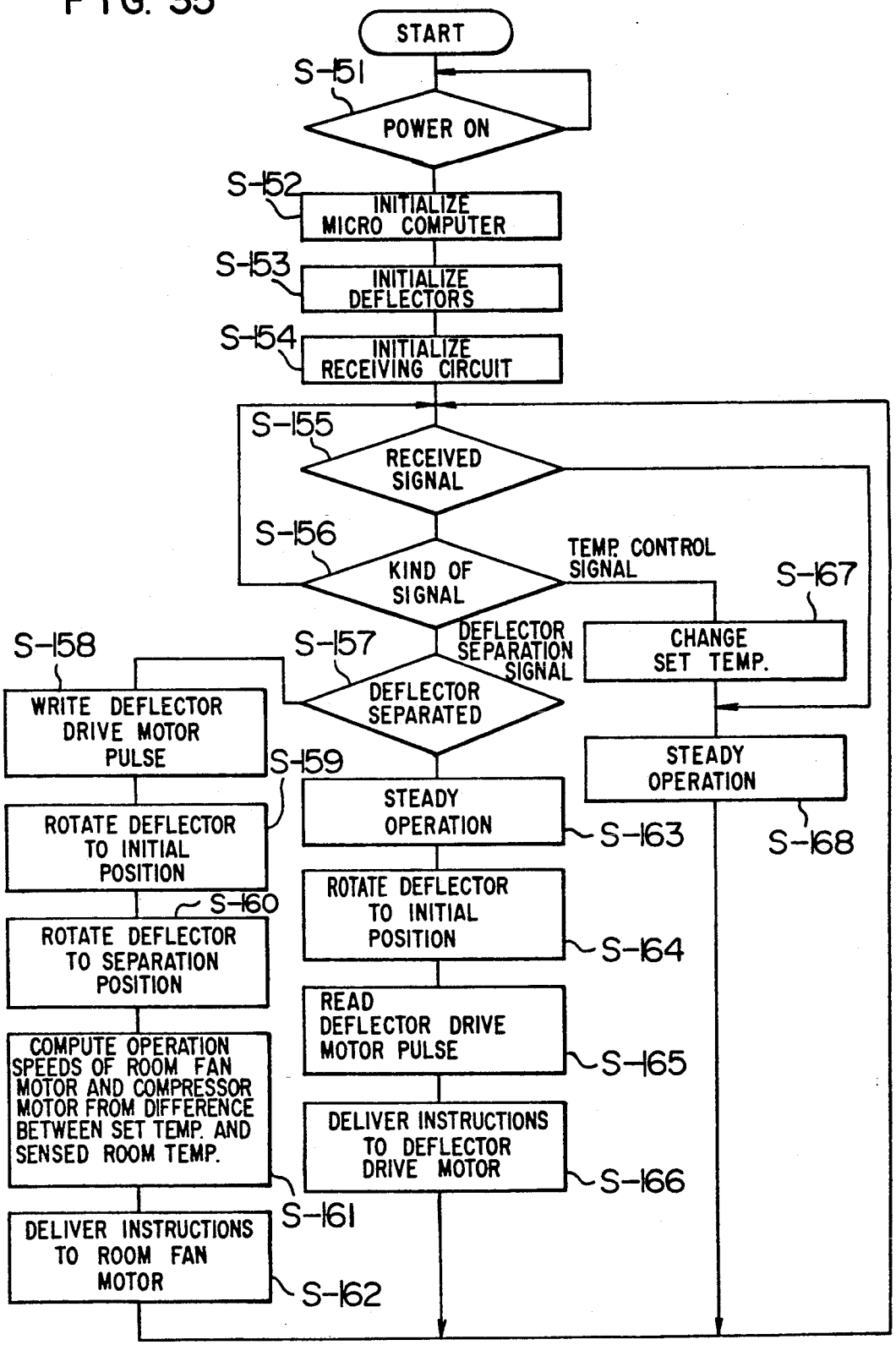
FIG. 35 is a flow chart illustrative of the operation of the whole air conditioner of the still further embodiment.

Referring to FIG. 35 showing the process of control of the air conditioner, when an on-state of the power supply 30 is confirmed in step S-151, step S-152 is executed in which an operation for initializing the microcomputer 54, initialization of the control section 59, clearing of the memory section 60 storing data such as the number of pulses supplied to the vane driving motor and set temperature, and so forth is conducted.

Subsequently, step S-153 is executed in which the main deflector 102 is set at an initial position, e.g., in the position shown in FIG. 30, by driving the main deflector 102 by the motor 10a. The receiving circuit 55 is then initialized in step S-154.

After the initializing operations, the process proceeds to step S-155 which waits for any signal to be received by the receiving circuit 55. When a signal is received, the kind of the signal is determined in step S-156. When this signal is a deflector separation signal, an operation is conducted to check whether the auxiliary deflector has been separated from the main deflector in step S-157. If the answer to this query is NO, the number of pulses to be supplied to the motor 10a is stored in the memory section 60 in step S-158. Subsequently, step S-159 is executed in which the main and auxiliary deflectors 102 and 103 are rotated as a unit to the position shown in FIG. 30, followed by step S-160 in which the main deflector 102 alone is rotated to the position shown in FIG. 28 where it forms an angle of 30° to 35° to the vertical plane.

Subsequently, the speeds at which the room fan motor and the compressor 57 are to be operated are computed based on the difference between the room temperature and the set temperature and instructions corresponding to the computed operation speeds are fed to the room fan motor 58 and the compressor 57, in steps S-161 and S-162.

The computation of the operation speeds of the room fan motor 58 and the compressor 57 may be conducted with reference to a control table similar to that described before in connection with the first embodiment.

Receipt of the deflector separation signal while the auxiliary deflector 103 has already been separated from the main deflector 102 means that the air conditioner is not in the start-up condition, so that an instruction signal is given in step S-163 to reset the room fan motor 58 and the compressor 57 to ordinary states of operation. Then, the deflector unit is rotated to the initial position shown in FIG. 30 in step S-164, and the number of pulses to be supplied to the motor 10*a* stored in the memory section 60 in advance of the separation of the deflectors is read in step S-165. Then, an instruction signal is given to the motor 10*a* in step S-166.

However, when the signal questioned in step S-156 is a temperature signal, the process proceeds to step S-167 in which the temperature set in the memory section 60 is changed and, thereafter, a normal operation of the air conditioner is executed in step S-168.

As will be seen from the foregoing description, pressing of the air direction control button 41*a* on the remote controller 40 causes the auxiliary deflector 103 to be separated from the main deflector 102 when it has not been yet separated and, when the auxiliary deflector 103 has been separated from the main deflector 102, causes the auxiliary deflector 103 to rejoin the main deflector 102 to resume the initial blowing direction of the air. When the auxiliary deflector 103 has been separated, the auxiliary deflector blocks the peripheral region of the outlet 2 so that air is discharged mainly through the main deflector 102, whereas, when the auxiliary deflector 103 is held together with the main deflector 102, air is discharged through the entire portion of the outlet 2.

Figure 36:
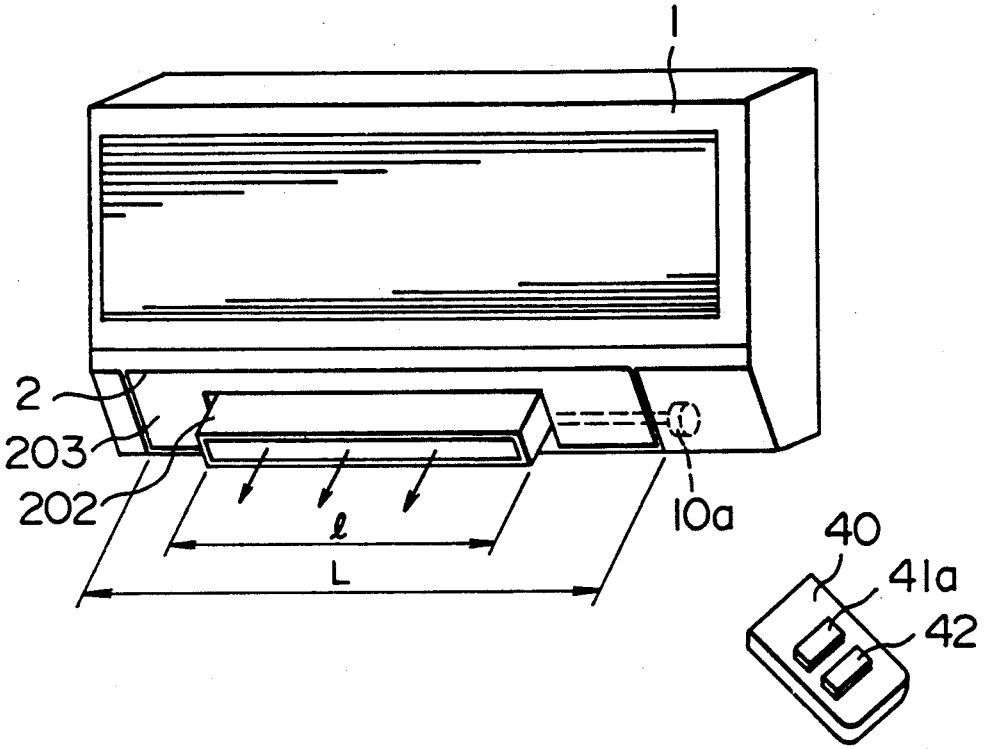
FIG. 36 is a perspective view of a room unit and a remote controller of a still further embodiment of the air conditioner in accordance with the present invention.
Figure 37:
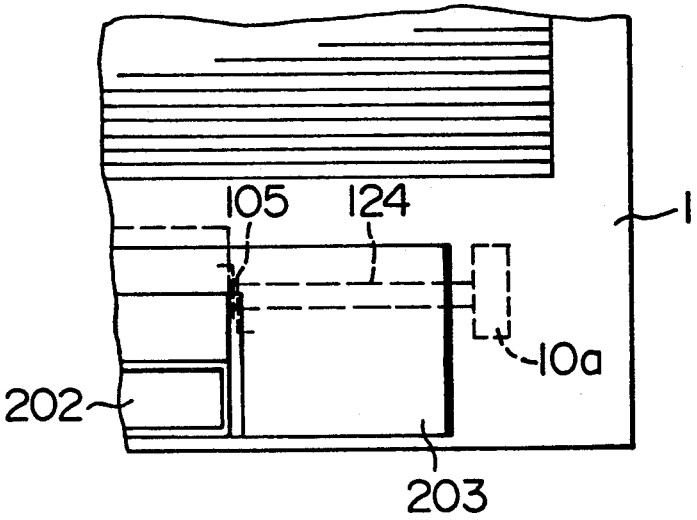
FIG. 37 is a fragmentary enlarged front view of the unit shown in FIG. 36.

Referring first to FIG. 36, a substantially rectangular outlet 2 is formed in a lower part of a front cover of the air conditioner. It will be seen that a main deflector 202 and an auxiliary deflector 203 are disposed so as to be able to close the central region and both breadthwise end regions of the outlet 2, respectively. The main and auxiliary deflectors 202 and 203 in cooperation form a deflector unit. Both the main and auxiliary deflectors 202 and 203 are rotatable independently of each other. More specifically, it is possible to rotate the main deflector 202 alone in a clockwise direction as viewed in FIG. 36 about a horizontal axis coaxial with a motor 10*a* so as to partly open the outlet 2 while leaving the auxiliary deflector 203 in the blocking position. In this state, the outlet 2 is opened only over a horizontal length or breadth l of the main deflector 202 which is smaller than the breadth L of the auxiliary deflector 203, so that the air passage is restricted. Conversely, when the auxiliary deflector 203 and the main deflector 202 are rotated as a unit in a counter-clockwise direction as viewed in FIG. 36, about the axis coaxial with the motor 10*a* so that the outlet 2 is fully opened so that the air is allowed to be discharged through the entire breadthwise portion of the outlet 2, whereby a greater cross-sectional area of the air passage is obtained.

Figure 38:
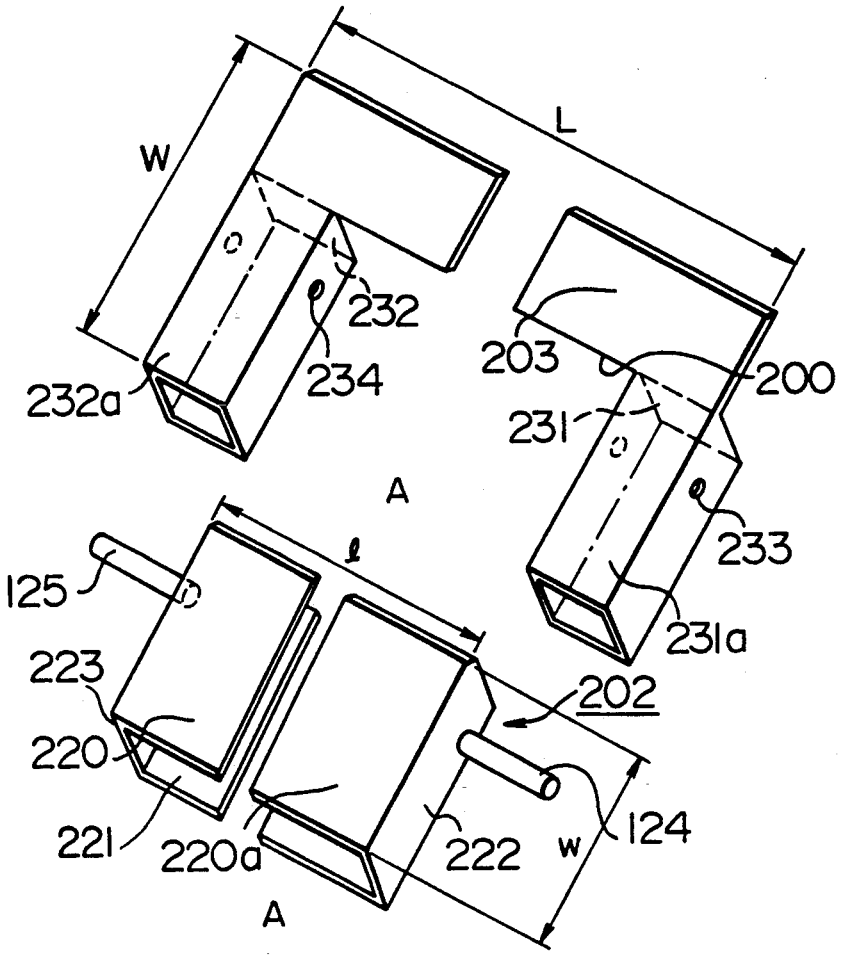
FIG. 38 is a schematic exploded perspective view of an air deflector of the unit shown in FIG. 36.

Referring to FIG. 38, the main deflector 202 has a substantially rectangular tubular portion 220*a* formed of front and rear panels 220 and 221 and both side panels 222 and 223. Air is allowed to pass through the central tubular portion 220*a* and both tubular wing portions as indicated by arrows A. Trunnion shafts 124 and 125 are provided on both side plates 222 and 223. One or both of these trunnion shafts are suitably driven by the motor 10*a* to rotate the main deflector 202 about the axis of the trunnion shafts 124 and 125.

The auxiliary deflector 203 has a central notched portion 200 capable of receiving the central tubular portion 220*a* of the main deflector 202 and is shaped to fit to the upper and both lateral sides of the central tubular portion 220*a*. The breadth L and the height W of the auxiliary deflector 203 are substantially the same as those of the outlet 2 formed in the front panel of the air conditioner. The auxiliary deflector 103 is provided at its both breadthwise end portions with tubular portions 231*a* and 232*a*. These tubular portions 231*a* and 232*a* are provided with apertures 233 and 234 for receiving the trunnion shafts 124 and 125 of the main deflector 202.

Figure 39:
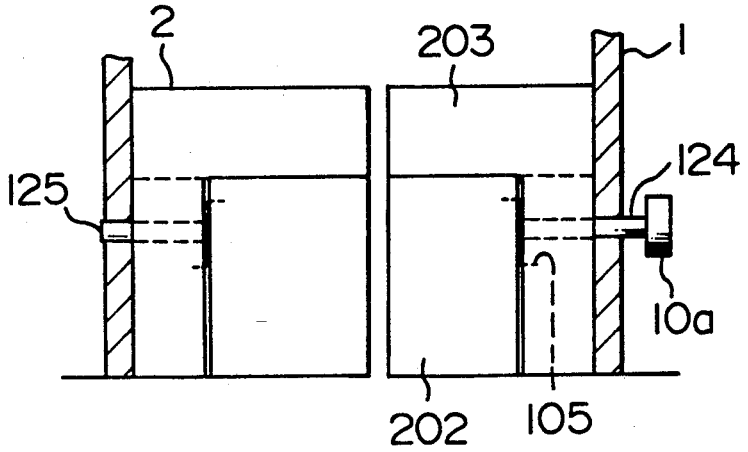
FIG. 39 is a front elevational view of the air deflector in assembled state.

As schematically shown in FIG. 39, the trunnion shafts 124 and 125 of the main deflector 202 extend outwardly through the apertures 223 and 224 formed in the tubular portions 231*a* and 232*a* of the auxiliary deflector 103 so as to be journaled by the casing of the air conditioner. The main deflector 202 and the auxiliary deflector 203 are connected to each other through springs 105 so that the main deflector 102 and the auxiliary deflector 103 rotate as a unit when the trunnion shaft 124 or 125 is driven unless any external force is applied. In a closed position of the deflector unit similar to the position shown in FIG. 32 the outlet 2 is substantially completely closed by the main deflector 202 and the auxiliary deflector 203.

Other portions of the construction and operation of the embodiment are not described because they are substantially the same as those of the embodiment described before in connection with FIGS. 26 to 35.

What is claimed is:

1. An air conditioner including an outlet for discharging a conditioned air flow and air deflector means associated with said outlet, wherein said air deflector means include:

first deflector means rotatable about a substantially horizontal axis to variably deflect air through said outlet in vertical directions; and second deflector means rotatable to block a predetermined breadthwise portion of said outlet while forming an air passage in at least one other breadthwise portion of said outlet to thereby concentrate the air flow to said at least one other breadthwise portion of said outlet;

wherein said first deflector means comprise a single horizontal vane and wherein said second deflector means comprise a single movable vane which is rotatable about a substantially horizontal axis and capable of blocking one of left and right half portions of said outlet while forming said air passage in the other of said left and right half portions of said outlet.

2. An air conditioner including an outlet for discharging a conditioned air flow and air deflector means associated with said outlet, wherein said air deflector means include:

first deflector means rotatable about a substantially horizontal axis to variably deflect air through said outlet in vertical directions; and second deflector means rotatable to block a predetermined breadthwise portion of said outlet while forming an air passage in at least one other breadthwise portion of said outlet to thereby concentrate the air flow to said at least one other breadthwise portion of said outlet;

wherein said first deflector means comprise a single horizontal vane and wherein said second deflector means comprise a guide frame having a breadth substantially equal to a breadth of said outlet and rotatable about a substantially horizontal axis and a shield plate having a breadth smaller than said guide frame and supported by said guide frame for a sliding movement in a breadthwise direction of said outlet.

3. An air conditioner, including an outlet for discharging a conditioned air flow and air deflector means associated with said outlet, wherein said air deflector means include:

first deflector means rotatable about a substantially horizontal axis to variably deflect air through said outlet in vertical directions; and second deflector means rotatable to block a predetermined breadthwise portion of said outlet while forming an air passage in at least one other breadthwise portion of said outlet to thereby concentrate the air flow to said at least one other breadthwise portion of said outlet;

wherein said first deflector means comprise a main vane having a breadth substantially equal to said outlet and wherein said second deflector means comprise a first auxiliary vane fixed to said main vane substantially in parallel and in an opposing relationship therewith and having a breadth smaller than said main vane and a pair of second auxiliary vanes positioned on both breadthwise ends of said first auxiliary vane and connected to said main vane for rotation relative to said main vane about a substantially horizontal axis;

wherein said main vane has a vertical dimension height smaller than said outlet and wherein a movable vane is pivotally connected to one horizontal edge of said main vane and said movable vane has a breadth substantially equal to said outlet.

4. An air conditioner including an outlet for discharging conditioned air and air deflector means associated with said outlet, said air deflector means including:

first deflector means rotatable about a substantially horizontal axis to variably deflect air through said outlet in vertical directions, said first deflector means comprise a main vane having a breadth substantially equal to that of said outlet, said main vane having a vertical height smaller than that of said outlet;

second deflector means rotatable to block a predetermined breadthwise portion of said outlet while forming an air passage in at least one other breadthwise portion of said outlet, said second deflector means comprise a first auxiliary vane fixed to said main vane substantially in parallel and opposing relationship therewith and having a breadth smaller than that of said main vane and a pair of second auxiliary vanes positioned on both breadthwise ends of said first auxiliary vane and secured to said main vane for rotation relative to said main vane about a substantially horizontal axis;

a movable vane pivotally secured to one horizontal edge of said main vane, said movable vane having a breadth substantially the same as that of said outlet, wherein said movable vane forms with said main vane an angle only when said main vane is rotated in a predetermined direction about a substantially horizontal axis and said movable vane is substantially co-planar with said main vane when said main vane is rotated in a counter direction.

5. An air conditioner including an outlet for discharging conditioned air and air deflector means associated with said outlet, wherein said air deflector means include:

a first deflector means rotatable about a substantially horizontal axis to variably deflect air through said outlet in vertical directions, said first deflector means comprise a first deflector having a substantially rectangular tubular portion formed by front and rear panels and a pair of side panels; and second deflector means rotatable to block a predetermined breadthwise portion of said outlet while forming an air passage in at least one other breadthwise portion of said outlet, said second deflector means comprise a second deflector having a notched portion extending over a predetermined breadthwise portion thereof and rotatable about a substantially horizontal axis, said first deflector being rotatable relative to said second deflector between a first position in which said tubular portion of said first deflector is spaced from said notched portion of said second deflector and a second position in which said front and rear panel of said tubular portion of said first deflector block said notched portion of said second deflector.

6. An air conditioner according to claim 5, wherein, when said first deflector is rotated about a substantially horizontal axis in a predetermined direction, said first deflector rotationally drives said second deflector.

7. An air conditioner according to claim 5, further including resilient means disposed between said first deflector and said second deflector.

8. An air conditioner according to claim 7, wherein, when said first deflector is rotated in one direction, said second deflector is rotated together with said first deflector by the action of said resilient means, and, after said second deflector is stopped by a stopper disposed in said outlet, said first deflector alone is operationally separated from said second deflector and rotatable alone against the force of said resilient means.

9. An air conditioner according to claim 8, wherein, after said first deflector is operationally separated from said second deflector, conditioned air is discharged through said tubular portion of said first deflector.

10. An air conditioner according to claim 5, wherein said second deflector is provided on both breadthwise end portions thereof with tubular members which define air passages.

11. An air conditioner according to claim 5, further comprising a motor for rotatingly driving said first deflector.

12. An air conditioner for discharging conditioned air and air deflector means associated with said outlet, wherein said air deflector means include:

first deflector means rotatable about a substantially horizontal axis to variably deflect air through said outlet in vertical directions, said first deflector means comprise a horizontal vane;

second deflector means rotatable to block a predetermined breadthwise portion of said outlet while forming an air passage in at least one other breadthwise portion of said outlet, said second deflector means comprise at least two groups of vertical vanes capable of variably deflecting an air flow from said outlet in horizontal directions, the vertical vanes of one of said groups being rotatable to block a predetermined breadthwise portion of said outlet while the vertical vanes of the other group keep the other breadthwise portion of said outlet open to form said air passage; and actuators for said groups of vertical vanes and linkages respectively drivingly connecting said actuators to said groups of vertical vanes such that the vertical vanes of one of said groups are rotatable independently of the vanes of the other group.

* * * * *